US010656545B2

(12) United States Patent
Kamae et al.

(10) Patent No.: US 10,656,545 B2
(45) Date of Patent: May 19, 2020

(54) TONER AND METHOD FOR PRODUCING TONER

(71) Applicant: CANON KABUSHIKI KAISHA, Tokyo (JP)

(72) Inventors: Kentaro Kamae, Kashiwa (JP); Kazuhisa Shirayama, Abiko (JP); Takeshi Hashimoto, Moriya (JP); Hayato Ida, Toride (JP); Takashi Matsui, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/438,537

(22) Filed: Jun. 12, 2019

(65) Prior Publication Data

US 2019/0384196 A1 Dec. 19, 2019

(30) Foreign Application Priority Data

Jun. 13, 2018 (JP) ..... 2018-113139
Apr. 10, 2019 (JP) ..... 2019-074931

(51) Int. Cl.
*G03G 9/08* (2006.01)
*G03G 9/087* (2006.01)
*G03G 9/097* (2006.01)
*G03G 9/107* (2006.01)

(52) U.S. Cl.
CPC ..... *G03G 9/08728* (2013.01); *G03G 9/0806* (2013.01); *G03G 9/0821* (2013.01); *G03G 9/0825* (2013.01); *G03G 9/09708* (2013.01); *G03G 9/107* (2013.01)

(58) Field of Classification Search
CPC ..... G03G 9/08728; G03G 9/09708
USPC ..... 430/109.3
See application file for complete search history.

(56) References Cited

U.S. PATENT DOCUMENTS 7,678,523 B2 3/2010 Hiroko et al.
7,842,446 B2 11/2010 Yanase et al.
7,923,190 B2 4/2011 Magome et al.
7,935,467 B2 5/2011 Dojo et al.
8,084,174 B2 12/2011 Hasegawa et al.
8,323,726 B2 12/2012 Naka et al.
8,426,091 B2 4/2013 Magome et al.
8,426,094 B2 4/2013 Magome et al.
8,614,044 B2 12/2013 Matsui et al.
8,778,585 B2 7/2014 Matsui et al.
8,841,054 B2 9/2014 Dojo et al.
8,883,389 B2 11/2014 Matsui et al.
8,921,023 B2 12/2014 Baba et al.
8,927,188 B2 1/2015 Naka et al.
8,974,994 B2 3/2015 Kamae et al.
8,986,914 B2 3/2015 Fujikawa et al.
9,057,970 B2 6/2015 Ida et al.
9,058,924 B2 6/2015 Komatsu et al.
9,063,443 B2 6/2015 Ishigami et al.
9,097,997 B2 8/2015 Nomura et al.
9,152,088 B1 10/2015 Kobori et al.
9,213,250 B2 12/2015 Nomura et al.
9,217,943 B2 12/2015 Matsui et al.
9,239,528 B2 1/2016 Hasegawa et al.
9,304,422 B2 4/2016 Matsui et al.
9,348,246 B2 5/2016 Magome et al.
9,348,247 B2 5/2016 Ida et al.
9,348,253 B2 5/2016 Kanno et al.
9,354,545 B2 5/2016 Matsui et al.
9,417,540 B2 8/2016 Hashimoto et al.
9,436,112 B2 9/2016 Iwasaki et al.
9,442,416 B2 9/2016 Magome et al.
9,442,419 B2 9/2016 Wakabayashi et al.
9,540,483 B2 1/2017 Ida et al.
9,581,934 B2 2/2017 Ito et al.
9,651,883 B2 5/2017 Hama et al.
9,658,546 B2 5/2017 Tanaka et al.
9,665,023 B2 5/2017 Kamae et al.
9,696,644 B2 7/2017 Ida et al.
9,857,707 B2 1/2018 Tsuda et al.
9,897,934 B2 2/2018 Tamura et al.
(Continued)

FOREIGN PATENT DOCUMENTS

EP 0 703 505 3/1996
EP 0 744 668 11/1996
(Continued)

OTHER PUBLICATIONS

Fedors, "A Method for Estimating Both the Solubility Parameters and Molar Volumes of Liquids", Polymer Engineering and Science, vol. 14, No. 2 (1974) 147-54.
U.S. Appl. No. 16/438,541, Takeshi Hashimoto, filed Jun. 12, 2019.
U.S. Appl. No. 16/438,544, Kazuhisa Shirayama, filed Jun. 12, 2019.
U.S. Appl. No. 16/438,545, Kenta Kamikura, filed Jun. 12, 2019.
U.S. Appl. No. 16/438,553, Kenji Aoki, filed Jun. 12, 2019.
U.S. Appl. No. 16/438,566, Takashi Matsui, filed Jun. 12, 2019.
(Continued)

*Primary Examiner* — Mark A Chapman
(74) *Attorney, Agent, or Firm* — Venable LLP

(57) ABSTRACT

A toner has a toner particle including a binder resin, the binder resin includes a polymer A, the polymer A contains a first monomer unit derived from a first polymerizable monomer and a second monomer unit derived from a second polymerizable monomer, the first polymerizable monomer is selected from (meth)acrylic acid esters having an alkyl group having 18 to 36 carbon atoms, the content of the first monomer unit in the polymer A is 5.0 mol % to 60.0 mol %, the content of the second monomer unit in the polymer A is 20.0 mol % to 95.0 mol %, the SP value of the first monomer unit and the SP value of the second monomer unit satisfy a predetermined relationship, the polymer A includes a predetermined polyvalent metal, and the content of the polyvalent metal is 25 ppm to 500 ppm.

20 Claims, No Drawings

(56) References Cited

U.S. PATENT DOCUMENTS

| | | | |
|---|---|---|---|
| 9,904,195 | B2 | 2/2018 | Matsui et al. |
| 9,915,885 | B2 | 3/2018 | Katsumata et al. |
| 9,969,834 | B2 | 5/2018 | Ohtsu et al. |
| 10,012,918 | B2 | 7/2018 | Ishigami et al. |
| 10,012,919 | B2 | 7/2018 | Matsui et al. |
| 10,012,920 | B2 | 7/2018 | Shibata et al. |
| 10,012,921 | B2 | 7/2018 | Kamae et al. |
| 10,036,970 | B2 | 7/2018 | Kanno et al. |
| 10,078,281 | B2 | 9/2018 | Ida et al. |
| 10,082,743 | B2 | 9/2018 | Hama et al. |
| 10,088,765 | B2 | 10/2018 | Miyakai et al. |
| 10,133,201 | B2 | 11/2018 | Kamae et al. |
| 10,146,146 | B2 | 12/2018 | Komatsu et al. |
| 10,156,800 | B2 | 12/2018 | Tsuda et al. |
| 10,175,595 | B2 | 1/2019 | Onozaki et al. |
| 10,197,934 | B2 | 2/2019 | Matsui et al. |
| 10,197,936 | B2 | 2/2019 | Onozaki et al. |
| 10,203,619 | B2 | 2/2019 | Yamashita et al. |
| 10,216,108 | B2 | 2/2019 | Iwasaki et al. |
| 10,228,629 | B2 | 3/2019 | Tamura et al. |
| 10,234,777 | B2 | 3/2019 | Ohtsu et al. |
| 10,241,430 | B2 | 3/2019 | Kimura et al. |
| 10,274,851 | B2 | 4/2019 | Hashimoto et al. |
| 10,353,312 | B2 | 7/2019 | Kamae et al. |
| 10,401,748 | B2 | 9/2019 | Hashimoto et al. |
| 2004/0185367 | A1 | 9/2004 | Serizawa et al. |
| 2007/0166636 | A1 | 7/2007 | Daimon et al. |
| 2009/0087768 | A1 | 4/2009 | Tosaka et al. |
| 2009/0197192 | A1 | 8/2009 | Hiroko et al. |
| 2013/0108955 | A1 | 5/2013 | Shibata et al. |
| 2013/0244159 | A1 | 9/2013 | Ishigami et al. |
| 2013/0288173 | A1 | 10/2013 | Hashimoto et al. |
| 2014/0038098 | A1 | 2/2014 | Naka et al. |
| 2014/0134535 | A1 | 5/2014 | Baba et al. |
| 2014/0272698 | A1 | 9/2014 | Yamada et al. |
| 2014/0272699 | A1 | 9/2014 | Minaki et al. |
| 2014/0308611 | A1 | 10/2014 | Shimano et al. |
| 2014/0329176 | A1 | 11/2014 | Kanno et al. |
| 2015/0099227 | A1 | 4/2015 | Ida et al. |
| 2015/0185658 | A1 | 7/2015 | Wakabayashi et al. |
| 2017/0045834 | A1 | 2/2017 | Shirai et al. |
| 2017/0269496 | A1 | 9/2017 | Kubo et al. |
| 2017/0315463 | A1 | 11/2017 | Onozaki et al. |
| 2018/0143557 | A1 | 5/2018 | Ueda et al. |
| 2018/0259867 | A1 | 9/2018 | Sano et al. |
| 2018/0275540 | A1 | 9/2018 | Matsuo et al. |
| 2018/0314176 | A1 | 11/2018 | Ikeda et al. |
| 2018/0356746 | A1 | 12/2018 | Hama et al. |
| 2018/0364601 | A1 | 12/2018 | Onozaki et al. |
| 2019/0107793 | A1 | 4/2019 | Tamura et al. |
| 2019/0113858 | A1 | 4/2019 | Kamae et al. |
| 2019/0171125 | A1 | 6/2019 | Kanno et al. |

FOREIGN PATENT DOCUMENTS

| | | |
|---|---|---|
| EP | 1 494 087 | 1/2005 |
| EP | 2 626 745 | 8/2013 |
| EP | 2 843 473 | 3/2015 |
| JP | 2000-250264 | 9/2000 |
| JP | 2011-094137 | 5/2011 |
| JP | 2012-247629 | 12/2012 |
| JP | 2013-228724 | 11/2013 |
| JP | 2014-130243 | 7/2014 |
| JP | 2014-199423 | 10/2014 |
| JP | 2014-222259 | 11/2014 |

OTHER PUBLICATIONS

U.S. Appl. No. 16/438,605, Daisuke Yoshiba, filed Jun. 12, 2019.
U.S. Appl. No. 16/438,611, Hiroki Kagawa, filed Jun. 12, 2019.
U.S. Appl. No. 16/438,623, Tatsuya Saeki, filed Jun. 12, 2019.
U.S. Appl. No. 16/203,864, Takeshi Ohtsu, filed Nov. 29, 2018.
U.S. Appl. No. 16/532,887, Ryuji Murayama, filed Aug. 6, 2019.
U.S. Appl. No. 16/534,343, Kentaro Kamae, filed Aug. 7, 2019.
U.S. Appl. No. 16/550,410, Masayuki Hama, filed Aug. 26,2019.

TONER AND METHOD FOR PRODUCING TONER

BACKGROUND OF THE INVENTION

Field of the Invention

The present invention relates to a toner suitable for an electrophotographic system, an electrostatic recording system, an electrostatic printing system and the like, and a method for producing the toner.

Description of the Related Art

As electrophotographic full-color copiers have become widespread in recent years, additional performance improvements such as higher speed and higher image quality and also energy saving performance and shortening of recovery time from the sleep state are required.

Specifically, a toner that can be fixed at a lower temperature in order to reduce power consumption in a fixing process is needed to comply with energy saving requirements. Further, a toner excellent in charge retention property, which demonstrates small variation in charge quantity through a long sleep state, is needed as a toner capable of shortening the recovery time from the sleep state.

Accordingly, in JP-A-2014-199423 and JP-A-2014-130243, a toner using a crystalline resin is proposed as a toner excellent in low-temperature fixability. JP-A-2012-247629 proposes a toner using an anti-static composition as a crystal nucleating agent as a toner excellent in charge retention property.

SUMMARY OF THE INVENTION

Since the toner described in JP-A-2014-199423 uses a crystalline resin having a sharp melt property, excellent low-temperature fixing is possible. However, since the crystalline resin is used as a main binder, the elastic modulus of the toner is lower than that of the toner using an amorphous resin. Therefore, when long-term image output is performed in a high-temperature and high-humidity environment, coarse particles, which are aggregates of the toner, may be generated due to a load such as stirring by a developing device. Then, such coarse particles may be caught between a developing sleeve and a regulating blade, and an image defect (development stripe) may occur because the portion where the coarse particles are caught is not developed.

Meanwhile, in the toner described in JP-A-2014-130243, excellent crystallinity of a crystalline resin having a low glass transition temperature is promoted and hydrophobicity is high, whereby excellent charge retention property is ensured. However, for the same reason as related to the toner described in JP-A-2014-199423, an image defect (development stripe) may occur.

As described in JP-A-2014-199423 and JP-A-2014-130243, the crystalline resin has a melting point and therefore exhibits excellent low-temperature fixability. Meanwhile, the crystalline resin has a low glass transition temperature, which is an index of molecular mobility, and therefore, development stripes are easily generated. Accordingly, it has been proposed to promote crystallinity of the binder resin by adding a crystal nucleating agent as described in JP-A-2012-247629, or to introduce an annealing step or the like, but the resulting effect on the suppression of development stripes is negligible.

Accordingly, it has been proposed to provide a toner with a core-shell structure and use a resin having a high glass transition temperature as a shell material.

However, the low-temperature fixability is determined by the melting deformation start temperature of a very small part of the toner, whereas when a resin having a high glass transition temperature is used as the shell material, the melting deformation of the toner is less likely to occur. As a result, in some cases, excellent low-temperature fixability cannot be obtained.

It follows from the above, that the low-temperature fixability and the development stripes are in a trade-off relationship. Therefore, in order to overcome this trade-off relationship and to show excellent low-temperature fixability, it is urgently necessary to develop a toner that makes it possible to suppress development stripes even in long-term image output under a high-temperature and high-humidity environment and exhibits excellent charge retention property.

The present invention has been accomplished in view of the above problems. The present invention provides a toner that exhibits excellent low-temperature fixability and also makes it possible to suppress development stripes even in long-term image output under a high-temperature and high-humidity environment and exhibits excellent charge retention property. The present invention also provides a method for producing such toner.

The present invention in its first aspect provides a toner containing a toner particle including a binder resin, wherein the binder resin includes a polymer A, the polymer A contains a first monomer unit derived from a first polymerizable monomer, and a second monomer unit derived from a second polymerizable monomer different from the first polymerizable monomer;

the first polymerizable monomer is at least one selected from the group consisting of (meth)acrylic acid esters having an alkyl group having 18 to 36 carbon atoms;

a content of the first monomer unit in the polymer A is 5.0 mol % to 60.0 mol % based on the total number of moles of all the monomer units in the polymer A;

a content of the second monomer unit in the polymer A is 20.0 mol % to 95.0 mol % based on the total number of moles of all the monomer units in the polymer A;

where an SP value of the first monomer unit is denoted by $SP_{11}$ $(J/cm^3)^{0.5}$ and an SP value of the second monomer unit is denoted by $SP_{21}$ $J/cm^3)^{0.5}$, following formulas (1) and (2) are satisfied;

the polymer A includes a polyvalent metal;

the polyvalent metal is at least one selected from the group consisting of Mg, Ca, Al, and Zn; and a content of the polyvalent metal in the toner particle is 25 ppm to 500 ppm on a mass basis.

$$3.00 \leq (SP_{21} - SP_{11}) \leq 25.00 \quad (1)$$

$$21.00 \leq SP_{21} \quad (2)$$

The present invention in its second aspect provides a toner containing a toner particle including a binder resin, wherein the binder resin includes a polymer A, the polymer A is a polymer of a composition including:

a first polymerizable monomer, and a second polymerizable monomer different from the first polymerizable monomer;

the first polymerizable monomer is at least one selected from the group consisting of (meth)acrylic acid esters having an alkyl group having 18 to 36 carbon atoms;

a content of the first polymerizable monomer in the composition is 5.0 mol % to 60.0 mol % based on the total number of moles of all the polymerizable monomers in the composition;

a content of the second polymerizable monomer in the composition is 20.0 mol % to 95.0 mol % based on the total number of moles of all the polymerizable monomers in the composition;

where an SP value of the first polymerizable monomer is denoted by $SP_{12}$ $(J/cm^3)^{0.5}$ and an SP value of the second polymerizable monomer is denoted by $SP_{22}$ $(J/cm^3)^{0.5}$, following formulas (4) and (5) are satisfied;

the polymer A includes a polyvalent metal;

the polyvalent metal is at least one selected from the group consisting of Mg, Ca, Al, and Zn; and a content of the polyvalent metal in the toner particle is 25 ppm to 500 ppm on a mass basis.

$$0.60 \leq (SP_{22} - SP_{12}) \leq 15.00 \quad (4)$$

$$18.30 \leq SP_{22} \quad (5)$$

Further, a method for producing a toner of the present invention, comprises:

a step of preparing a resin fine particle-dispersed solution including a binder resin;

a step of adding a flocculant to the resin fine particle-dispersed solution to form aggregated particles; and a step of heating and fusing the aggregated particles to obtain a dispersion solution including toner particles, wherein the binder resin includes a polymer A, the polymer A is a polymer of a composition including:

a first polymerizable monomer, and a second polymerizable monomer different from the first polymerizable monomer;

the first polymerizable monomer is at least one selected from the group consisting of (meth)acrylic acid esters having an alkyl group having 18 to 36 carbon atoms;

a content of the first polymerizable monomer in the composition is 5.0 mol % to 60.0 mol % based on the total number of moles of all the polymerizable monomers in the composition;

a content of the second polymerizable monomer in the composition is 20.0 mol % to 95.0 mol % based on the total number of moles of all the polymerizable monomers in the composition;

where an SP value of the first polymerizable monomer is denoted by $SP_{12}$ $(J/cm^3)^{0.5}$ and an SP value of the second polymerizable monomer is denoted by $SP_{22}$ $J/cm^3)^{0.5}$, following formulas (4) and (5) are satisfied;

the polymer A includes a polyvalent metal;

the polyvalent metal is at least one selected from the group consisting of Mg, Ca, Al, and Zn; and a content of the polyvalent metal in the toner particle is 25 ppm to 500 ppm on a mass basis.

$$0.60 \leq (SP_{22} - SP_{12}) \leq 15.00 \quad (4)$$

$$18.30 \leq SP_{22} \quad (5)$$

According to the present invention, it is possible to provide a toner that exhibits excellent low-temperature fixability and also makes it possible to suppress development stripes even in long-term image output under a high-temperature and high-humidity environment and exhibits excellent charge retention property, and to provide a method for producing the toner.

Further features of the present invention will become apparent from the following description of exemplary embodiments.

DESCRIPTION OF THE EMBODIMENTS

In the present invention, the expression "from XX to YY" or "XX to YY" representing the numerical range means a numerical range including a lower limit and an upper limit which are endpoints unless otherwise specified.

In the present invention, a (meth)acrylic acid ester means an acrylic acid ester and/or a methacrylic acid ester.

In the present invention, for a "monomer unit", one carbon-carbon bond segment in the main chain of a polymer obtained by polymerization of a vinyl monomer is taken as one unit. The vinyl monomer can be represented by a following formula (Z).

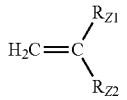

(Z)

(Wherein, $R_{Z1}$ represents a hydrogen atom or an alkyl group (preferably an alkyl group having 1 to 3 carbon atoms, more preferably a methyl group), and $R_{Z2}$ represents an arbitrary substituent).

The crystalline resin refers to a resin that shows a clear endothermic peak in differential scanning calorimetry (DSC) measurement.

The inventors of the present invention have studied toners that are excellent in low-temperature fixability and charge retention property in a high-temperature and high-humidity environment and make it possible to suppress development stripes in a high-temperature and high-humidity environment. As a result, the inventors of the present invention have found that it is possible to obtain a desired toner by causing appropriate crosslinking of a crystalline resin having a specific structure. Specifically, it has been found that it is important to include a polyvalent metal in a crystalline resin obtained by block polymerization of two or more monomer units that differ greatly in polarity from each other.

That is, two or more monomer units that differ greatly in polarity from each other form a micro-phase-separated state in a toner particle. Then, the polyvalent metal is oriented to a monomer unit phase having a relatively large polarity (hereinafter, also referred to as "polar portion"), and crosslinking of the polyvalent metal and the polar portion of the toner particle is formed. A monomer unit phase having a relatively small polarity (hereinafter, also referred to as a "non-crosslinked portion") that contributes to the low-temperature fixability and charge retention property and the crosslinked portion of the polyvalent metal and the polar portion of the toner particle that contributes to the charge retention property and the suppression of development stirpes can be formed in a network shape throughout the toner particle while forming a domain matrix structure in which the domain phase consisting of the crosslinked portion is dispersed in the matrix phase consisting of the non-crosslinked portion. Therefore, it is possible to obtain a toner which is excellent in low-temperature fixability, makes it possible to suppress development stripes even in a high-temperature and high-humidity environment, and is excellent in charge retention property. The above effect is exhibited because the molecular mobility of the binder resin is suppressed by the crosslinking. That is, as a result of suppressing the molecular mobility of the binder resin, the elastic modulus of the toner is improved, and resistance to mechanical action such as agitation by the developing device is demonstrated, so that the development stripes are suppressed. Further, the formation of the crosslinking suppresses the transfer of the charge of the binder resin, thereby improving the charge retention property. Meanwhile, even though the crosslinking is formed, thermal responsiveness of the binder resin does not change, so that the low-temperature fixability can be maintained.

In the toner according to the first aspect of the present invention, the binder resin includes a polymer A, the polymer A contains a first monomer unit derived from a first polymerizable monomer, and a second monomer unit derived from a second polymerizable monomer different from the first polymerizable monomer;

the first polymerizable monomer is at least one selected from the group consisting of (meth)acrylic acid esters having an alkyl group having 18 to 36 carbon atoms;

a content of the first monomer unit in the polymer A is 5.0 mol % to 60.0 mol % based on the total number of moles of all the monomer units in the polymer A;

a content of the second monomer unit in the polymer A is 20.0 mol % to 95.0 mol % based on the total number of moles of all the monomer units in the polymer A;

where an SP value of the first monomer unit is denoted by $SP_{11}$ $(J/cm^3)^{0.5}$ and an SP value of the second monomer unit is denoted by $SP_{21}$ $(J/cm^3)^{0.5}$, the following formulas (1) and (2) are satisfied.

$$3.00 \leq (SP_{21} - SP_{11}) \leq 25.00 \quad (1)$$

$$21.00 \leq SP_{21} \quad (2)$$

Further, in the toner according to the second aspect of the present invention, the binder resin includes a polymer A, the polymer A is a polymer of a composition including:

a first polymerizable monomer, and a second polymerizable monomer different from the first polymerizable monomer;

the first polymerizable monomer is at least one selected from the group consisting of (meth)acrylic acid esters having an alkyl group having 18 to 36 carbon atoms;

a content of the first polymerizable monomer in the composition is 5.0 mol % to 60.0 mol % based on the total number of moles of all the polymerizable monomers in the composition;

a content of the second polymerizable monomer in the composition is 20.0 mol % to 95.0 mol % based on the total number of moles of all the polymerizable monomers in the composition;

where an SP value of the first polymerizable monomer is denoted by $SP_{12}$ $(J/cm^3)^{0.5}$ and an SP value of the second polymerizable monomer is denoted by $SP_{22}$ $(J/cm^3)^{0.5}$, the following formulas (4) and (5) are satisfied.

$$0.60 \leq (SP_{22} - SP_{12}) \leq 15.00 \quad (4)$$

$$18.30 \leq SP_{22} \quad (5)$$

Here, the SP value is an abbreviation of solubility parameter and is a value serving as an indicator of solubility. The calculation method thereof will be described hereinbelow.

In the present invention, the binder resin includes the polymer A. The polymer A is a polymer of a composition including a first polymerizable monomer and a second polymerizable monomer different from the first polymerizable monomer. Further, the polymer A has a first monomer unit derived from the first polymerizable monomer and a second monomer unit derived from the second polymerizable monomer different from the first polymerizable monomer.

The first polymerizable monomer is at least one selected from the group consisting of (meth)acrylic acid esters having an alkyl group having 18 to 36 carbon atoms. The first monomer unit is derived from the first polymerizable monomer.

Since the abovementioned (meth)acrylic acid ester has a long alkyl group, it can impart crystallinity to the binder resin. As a result, the toner exhibits sharp melt property and demonstrates excellent low-temperature fixability. Furthermore, since the (meth)acrylic acid ester is highly hydrophobic, the hygroscopicity thereof in a high-temperature and high-humidity environment is low, which contributes to excellent charge retention property.

Meanwhile, when a (meth)acrylic acid ester has an alkyl group having less than 18 carbon atoms, since the chain of the alkyl group is short, the resulting polymer A is low in hydrophobicity and highly hygroscopic under a high-temperature and high-humidity environment, which results in poor charge retention property. Moreover, when a (meth) acrylic acid ester has an alkyl group having more than 37 carbon atoms, the (meth)acrylic acid ester has a long-chain alkyl group, so that the melting point thereof is high and the low-temperature fixability is poor.

The (meth)acrylic acid ester having an alkyl group having 18 to 36 carbon atoms can be exemplified by (meth)acrylic acid esters having a linear alkyl group having 18 to 36 carbon atoms [stearyl (meth)acrylate, nonadecyl (meth) acrylate, eicosyl (meth)acrylate, heneiicosanyl (meth)acrylate, behenyl (meth)acrylate, lignoceryl (meth)acrylate, ceryl (meth)acrylate, octacosyl (meth)acrylate, myricyl (meth)acrylate, dotriacontyl (meth)acrylate and the like] and (meth)acrylic acid esters having a branched alkyl group having 18 to 36 carbon atoms [2-decyltetradecyl (meth)ate and the like].

Among them, from the viewpoint of low-temperature fixability, at least one selected from the group consisting of (meth)acrylic acid esters having a linear alkyl group having 18 to 36 carbon atoms is preferable, at least one selected from the group consisting of (meth)acrylic acid esters having a linear alkyl group having 18 to 30 carbon atoms is more preferable, and at least one of linear stearyl (meth) acrylate and behenyl (meth)acrylate is even more preferable.

The first polymerizable monomers may be used singly or in combination of two or more thereof.

The second polymerizable monomer is a polymerizable monomer different from the first polymerizable monomer and satisfies the formulas (1) and (2), or the formulas (4) and (5). Further, the second monomer unit is derived from the second polymerizable monomer. The second polymerizable monomers may be used singly or in combination of two or more thereof.

The second polymerizable monomer preferably has an ethylenically unsaturated bond, and more preferably one ethylenically unsaturated bond.

The second polymerizable monomer is preferably at least one selected from the group consisting of compounds represented by the following formulas (A) and (B).

(A)

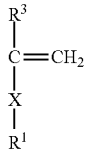

(B)

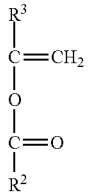

(Where, X represents a single bond or an alkylene group having 1 to 6 carbon atoms, $R^1$ is a nitrile group (—C≡N), an amide group (—(=O)NHR$^{10}$ ($R^{10}$ is a hydrogen atom or an alkyl group having 1 to 4 carbon atoms)), a hydroxy group, —COOR$^{11}$ ($R^{11}$ is an alkyl group having 1 to 6 carbon atoms (preferably 1 to 4 carbon atoms) or a hydroxyalkyl group having 1 to 6 carbon atoms (preferably 1 to 4 carbon atoms)), a urethane group (—NHCOOR$^{12}$ ($R^{12}$ is an alkyl group having 1 to 4 carbon atoms)), a urea group (—NH—C(=O)—N($R^{13}$)$_2$ ($R^{13}$ independently represent a hydrogen atom or an alkyl group having 1 to 6 carbon atoms (preferably 1 to 4 carbon atoms))), —COO(CH$_2$)$_2$NHCOOR$^{14}$ ($R^{14}$ is an alkyl group having 1 to 4 carbon atoms), or —COO(CH$_2$)$_2$—NH—C(=O)—N($R^{15}$)$_2$ ($R^{15}$ independently represent a hydrogen atom or an alkyl group having 1 to 6 carbon atoms (preferably 1 to 4 carbon atoms)).

Preferably, $R^1$ is a nitrile group (—C≡N), an amide group (—C(=O)NHR$^{10}$ ($R^{10}$ is a hydrogen atom or an alkyl group having 1 to 4 carbon atoms)), a hydroxy group, —COOR$^{11}$ ($R^{11}$ is an alkyl group having 1 to 6 carbon atoms (preferably 1 to 4 carbon atoms) or a hydroxyalkyl group having 1 to 6 carbon atoms (preferably 1 to 4 carbon atoms)), a urea group (—NH—C(=O)—N($R^{13}$)$_2$ ($R^{13}$ independently represent a hydrogen atom or an alkyl group having 1 to 6 carbon atoms(preferably 1 to 4 carbon atoms))), —COO(CH$_2$)$_2$NHCOOR$^{14}$ ($R^{14}$ is an alkyl group having 1 to 4 carbon atoms), or —COO(CH$_2$)$_2$—NH—C(=O)—N($R^{15}$)$_2$ ($R^{15}$ independently represent a hydrogen atom or an alkyl group having 1 to 6 carbon atoms (preferably 1 to 4 carbon atoms)).

$R^2$ is an alkyl group having 1 to 4 carbon atoms, and $R^3$ are each independently a hydrogen atom or a methyl group).

As a result of using at least one selected from the group consisting of compounds represented by the above formulas (A) and (B) as the second polymerizable monomer, the second monomer unit becomes particularly polar, and the micro-phase-separated state can be advantageously formed in the toner particle. Moreover, a polyvalent metal can be advantageously oriented to the polar portion, and a network-shaped crosslinked portion can be advantageously formed. Furthermore, in the case of crosslinking of the polyvalent metal with the monomer unit derived from at least one compound selected from the group of compounds represented by formulas (A) and (B), the bond between the monomer unit and the polyvalent metal is not too strong as compared with that obtained with crosslinking of the below-described polyvalent metal and a polar portion having a carboxyl group. Therefore, development stripes can be suppressed without inhibiting the low-temperature fixability.

Furthermore, since a compound including at least one of a nitrile group and an amide group is nonionic while being highly polar, more appropriate crosslinking can be formed, and such a compound is more preferable as the second polymerizable monomer. In addition, since a compound including at least one of a nitrile group and an amide group is nonionic, the compound is highly hydrophobic and has a low hygroscopicity in a high-temperature and high-humidity environment. Therefore, such a compound is also preferable because excellent charge retention property can be demonstrated.

Further, specifically, among the polymerizable monomers listed below, for example, a polymerizable monomer which satisfies the formulas (1) and (2), or the formulas (4) and (5) can be used as the second polymerizable monomer.

A monomer having a nitrile group, for example, acrylonitrile, methacrylonitrile and the like.

A monomer having a hydroxy group, for example, 2-hydroxyethyl (meth)acrylate, 2-hydroxypropyl (meth)acrylate and the like.

A monomer having an amide group, for example, acrylamide and a monomer obtained by reacting an amine having 1 to 30 carbon atoms and a carboxylic acid having 2 to 30 carbon atoms and an ethylenically unsaturated bond (such as acrylic acid and methacrylic acid) by a known method.

A monomer having a urethane group, for example, a monomer obtained by reacting an alcohol having 2 to 22 carbon atoms and an ethylenically unsaturated bond (2-hydroxyethyl methacrylate, vinyl alcohol and the like) and an isocyanate having 1 to 30 carbon atoms [a monoisocyanate compound (benzenesulfonyl isocyanate, tosyl isocyanate, phenyl isocyanate, p-chlorophenyl isocyanate, butyl isocyanate, hexyl isocyanate, t-butyl isocyanate, cyclohexyl isocyanate, octyl isocyanate, 2-ethylhexyl isocyanate, dodecyl isocyanate, adamantyl isocyanate, 2,6-dimethylphenyl isocyanate, 3,5-dimethylphenyl isocyanate, 2,6-dipropylphenyl isocyanate and the like), an aliphatic diisocyanate compound (trimethylene diisocyanate, tetramethylene diisocyanate, hexamethylene diisocyanate, pentamethylene diisocyanate, 1,2-propylene diisocyanate, 1,3-butylene diisocyanate, dodecamethylene diisocyanate, 2,4,4-trimethylhexamethylene diisocyanate and the like), an alicyclic diisocyanate compound (1,3-cyclopentene diisocyanate, 1,3-cyclohexane diisocyanate, 1,4-cyclohexane diisocyanate, isophorone diisocyanate, hydrogenated diphenylmethane diisocyanate, hydrogenated xylylene diisocyanate, hydrogenated tolylene diisocyanate, hydrogenated tetramethyl xylylene diisocyanate and the like), and an aromatic diisocyanate compound (phenylene diisocyanate, 2,4-tolylene diisocyanate, 2,6-tolylene diisocyanate, 2,2'-diphenylmethane diisocyanate, 4,4'-diphenylmethane diisocyanate, 4,4'-toluidine diisocyanate, 4,4'-diphenylether diisocyanate, 4,4'-diphenyl diisocyanate, 1,5-naphthalene diisocyanate, xylylene diisocyanate and the like)] by a known method, and a monomer obtained by reacting an alcohol having 1 to 26 carbon atoms (methanol, ethanol, propanol, isopropyl alcohol, butanol, t-butyl alcohol, pentanol, heptanol, octanol, 2-ethylhexanol, nonanol, decanol, undecyl alcohol, lauryl alcohol, dodecyl alcohol, myristyl alcohol, pentadecyl alcohol, cetanol, heptadecanol, stearyl alcohol, isostearyl alcohol, elaidyl alcohol, oleyl alcohol, linoleyl alcohol, linolenyl alcohol, nonadecyl alcohol, heneicosanol, behenyl alcohol, erucyl alcohol and the like) and an isocyanate having 2 to 30 carbon atoms and an ethylenically unsaturated bond [2-isocyanatoethyl (meth)acrylate, 2-(0-[1'-methylpropylideneamino]carboxyamino)ethyl (meth)acrylate, 2-[(3,5-dimethylpyrazolyl)carbonylamino]ethyl (meth)acrylate, 1,1-(bis(meth)acryloyloxymethyl)ethyl isocyanate and the like] by a well-known method.

A monomer having a urea group: for example, a monomer obtained by reacting an amine having 3 to 22 carbon atoms [a primary amine (n-butylamine, t-butylamine, propylamine, isopropylamine and the like), a secondary amine (di-n-ethylamine, di-n-propylamine, di-n-butylamine and the like), aniline, cycloxylamine and the like] and an isocyanate having 2 to 30 carbon atoms and an ethylenically unsaturated bond by a known method.

A monomer having a carboxy group, for example, methacrylic acid, acrylic acid, and 2-carboxyethyl (meth)acrylate.

Among them, it is preferable to use a monomer having a nitrile group, an amide group, a urethane group, a hydroxy group or a urea group. More preferably, it is a monomer having at least one functional group selected from the group consisting of a nitrile group, an amide group, a urethane group, a hydroxy group, and a urea group, and an ethylenically unsaturated bond.

Also, a vinyl ester such as vinyl acetate, vinyl propionate, vinyl butyrate, vinyl caproate, vinyl caprylate, vinyl caprate, vinyl caprate, vinyl laurate, vinyl myristate, vinyl palmitate, vinyl stearate, vinyl pivalate and vinyl octylate is preferably used as the second polymerizable monomer. Among them, since vinyl esters are non-conjugated monomers, easily maintain appropriate reactivity with the first polymerizable monomer is, and are likely to increase the crystallinity of the polymer, both the low-temperature fixability and the suppression of development stripes are likely to be achieved.

The content of the first monomer unit in the polymer A is 5.0 mol % to 60.0 mol % based on the total number of moles of all the monomer units in the polymer A. The content of the second monomer unit in the polymer A is 20.0 mol % to 95.0 mol % based on the total number of moles of all the monomer units in the polymer A. Further, the content of the first polymerizable monomer in the composition constituting the polymer A is 5.0 mol % to 60.0 mol % based on the total number of moles of all the polymerizable monomers in the composition, and the content of the second polymerizable monomer in the composition is 20.0% to 95.0 mol % based on the total number of moles of all the polymerizable monomers in the composition.

When the content of the first monomer unit and the content of the first polymerizable monomer are in the above ranges, the toner exhibits sharp melt property due to the crystallinity of the binder resin and demonstrates excellent low-temperature fixability. In addition, when the content of the second monomer unit and the content of the second polymerizable monomer are in the above ranges, the content of the second monomer unit or the second polymerizable monomer that can form crosslinking with the polyvalent metal is appropriate, and the network-shaped crosslinked portion can be formed throughout the toner particle. Therefore, it is possible to suppress the molecular mobility and exhibit excellent charge retention property, while suppressing the development stripes.

The content of the first monomer unit and the content of the first polymerizable monomer are preferably 10.0 mol % to 60.0 mol %, and more preferably 20.0 mol % to 40.0 mol %.

Meanwhile, when the content of the first monomer unit or the content of the first polymerizable monomer is less than 5.0 mol %, the ratio of the non-crosslinked portion having crystallinity is small, so the low-temperature fixability and charge retention property are poor. Further, when the content of the first monomer unit or the content of the first polymerizable monomer is more than 60.0 mol %, the ratio of the crosslinked portion between the polar portion and the polyvalent metal described hereinbelow is small, so that the effect of suppressing the development stripes is poor.

In addition, when the polymer A has a monomer unit derived from a (meth)acrylic acid ester having two or more alkyl groups having 18 to 36 carbon atoms, the content of the first monomer unit represents the molar ratio which is the sum total thereof. Likewise, when the composition used for the polymer A includes a (meth)acrylic acid ester having two or more alkyl groups having 18 to 36 carbon atoms, the content of the first polymerizable monomer represents the molar ratio which is the sum total thereof.

Further, when the content of the second monomer unit in the polymer A is less than 20.0 mol % based on the total number of moles of all the monomer units in the polymer A, the content of the monomer units forming the crosslinking is small, so that the effect of suppressing the development stripes and the charge retention property are poor. Further, when the content of the second monomer unit in the polymer A is more than 95.0 mol % based on the total number of moles of all the monomer units in the polymer A, the content of the monomer units to be crystallized is small, so that the low-temperature fixability is poor.

In addition, from the viewpoints of low-temperature fixability, suppression of development stripes, and charge retention property, the content of the second monomer unit in the polymer A is preferably 40.0 mol % to 95.0 mol % and more preferably 40.0 mol % to 70.0 mol % with respect to the total number of moles of all the monomer units in the polymer A because both the non-crosslinked portion having a sharp melt property and the crosslinked portion suppressing the reduction in the elastic modulus of the toner can be realized. For the same reason, the content of the second polymerizable monomer in the composition is preferably 40.0 mol % to 95.0 mol % and more preferably 40.0 mol % to 70.0 mol % with respect to the total number of moles of all the monomer units in the composition.

When two or more monomer units derived from the second polymerizable monomer satisfying the formula (1) are present in the polymer A, the ratio of the second monomer unit represents the molar ratio that is the sum total thereof. Further, when the composition used for the polymer A includes two or more second polymerizable monomers, the content of the second polymerizable monomer likewise represents the molar ratio that is the sum total thereof.

In the polymer A, where the SP value of the first monomer unit is denoted by $SP_{11}$ $(J/cm^3)^{0.5}$ and the SP value of the second monomer unit is denoted by $SP_{21}$ $J/cm^3)^{0.5}$, the following formulas (1) and (2) are satisfied.

$$3.00 \leq (SP_{21} - SP_{11}) \leq 25.00 \quad (1)$$

$$21.00 \leq SP_{21} \quad (2)$$

In the polymer A in the toner according to the second aspect of the present invention, where the SP value of the first polymerizable monomer is denoted by $SP_{12}$ $(J/cm^3)^{0.5}$ and the SP value of the second polymerizable monomer is denoted by $SP_{22}$ $(J/cm^3)^{0.5}$, the following formulas (4) and (5) are satisfied.

$$0.60 \leq (SP_{22}-SP_{12}) \leq 15.00 \quad (4)$$

$$18.30 \leq SP_{22} \quad (5)$$

Where the formulas (1) and (2) or the formulas (4) and (5) are satisfied, the second monomer unit becomes highly polar and a difference in polarity occurs between the first and second monomer units. Because of such a difference in polarity, a micro-phase-separated state can be formed in the toner. Then, the polyvalent metal can be oriented to the highly polar monomer unit portion to form a network-shaped crosslinking. As a result, the non-crosslinked portion contributing to the low-temperature fixability and the charge retention property, and the crosslinked portion contributing to the suppression of the development stripes and the charge retention property can be present in the form of a domain matrix. Therefore, it is possible to obtain a toner which is excellent in low-temperature fixability and charge retention property and can suppress the development stripes.

Although the unit of the SP value in the present invention is $(J/m^3)^{0.5}$, conversion to a $(cal/cm^3)^{0.5}$ unit can be made by 1 $(cal/cm^3)^{0.5}=2.045\times10^3$ $(J/m^3)^{0.5}$.

It is presumed that the following mechanism makes it possible to obtain excellent low-temperature fixability and charge retention property and suppress the development stripes by satisfying the formulas (1) and (2) or the formulas (4) and (5).

The first monomer units are incorporated into the polymer A, and the first monomer units aggregate to exhibit crystallinity. Usually, since the crystallization of the first monomer units is inhibited when other monomer units are incorporated, the polymer is unlikely to exhibit crystallinity. This tendency becomes remarkable when a plurality of types of monomer units is randomly bonded to each other in one molecule of the polymer.

Meanwhile, it is conceivable that in the present invention, as a result of using the first polymerizable monomer and the second polymerizable monomer so that the content of the first monomer unit and the second monomer units are within the ranges of the formulas (1) and (2), the first polymerizable monomer and the second polymerizable monomer can be continuously bonded to some extent instead of being randomly bonded at the time of polymerization. It is conceivable that for this reason, blocks in which the first monomer units are aggregated are formed, the polymer A becomes a block copolymer, and even if other monomer units are incorporated, the crystallinity can be enhanced and the melting point can be maintained. That is, it is preferable that the polymer A have a crystalline segment including the first monomer unit derived from the first polymerizable monomer. Moreover, it is preferable that the polymer A have an amorphous segment including the second monomer unit derived from the second polymerizable monomer.

Meanwhile, when $SP_{11}$ and $SP_{21}$, which are SP values of the monomer units, are $$(SP_{21}-SP_{11})<3.00,$$

it means that the difference in polarity between the monomer units is too small, a micro-phase-separated state cannot be formed in the toner, and the effect of suppressing the development stripes and the charge retention property are poor. Further, when $$25.00<(SP_{21}-SP_{11}),$$

it means that the difference in polarity between the monomer units is too large, the polymer A does not have a structure similar to that of a block copolymer, a spread in composition occurs among the toner particles, and the low-temperature fixability, the effect of suppressing the development stripes, and the charge retention property are poor.

In addition, when $SP_{21}$, which is the SP value of the second monomer unit, is $$SP_{21}<21.00,$$

the second monomer unit is low in polarity and no crosslinking is formed between the polar portion and the polyvalent metal, so that the effect of suppressing the development stripes and the charge retention property are poor.

The lower limit of $SP_{21}-SP_{11}$ is preferably 4.00 or more, and more preferably 5.00 or more. The upper limit is preferably 20.00 or less, and more preferably 15.00 or less. It is preferable that $SP_{21}$ be 22.00 or more.

In the toner according to the second aspect, when $SP_{12}$ and $SP_{22}$, which are SP values of the polymerizable monomers, are $$(SP_{22}-SP_{12})<0.60,$$

it means that the difference in polarity between the polymerizable monomers is too small, a micro-phase-separated state cannot be formed in the toner, and the effect of suppressing the development stripes and the charge retention property are poor. Further, when $$15.00<(SP_{22}-SP_{12}),$$

it means that the difference in polarity between the polymerizable monomers is too large, the polymer A does not have a structure similar to that of a block copolymer, a spread in composition occurs among the toner particles, and the low-temperature fixability, the effect of suppressing the development stripes, and the charge retention property are poor.

In addition, when $SP_{22}$, which is the SP value of the second polymerizable monomer, is $$SP_{22}<18.30,$$

the second polymerizable monomer is low in polarity and no crosslinking is formed between the polar portion and the polyvalent metal, so that the effect of suppressing the development stripes and the charge retention property are poor.

The lower limit of $SP_{22}-SP_{12}$ is preferably 2.00 or more, and more preferably 3.00 or more. The upper limit is preferably 10.00 or less, and more preferably 7.00 or less. It is preferable that $SP_{22}$ be 25.00 or more and more preferably 29.00 or more.

In the present invention, when a plurality of types of monomer units satisfying the requirement of the first monomer unit is present in the polymer A, the value of $SP_{11}$ in the formula (1) is assumed to be a value obtained by weighted averaging of the SP values of the respective monomer units. For example, the SP value ($SP_{11}$) when a monomer unit A with an SP value of $SP_{111}$ is included in A mol % based on the number of moles of all the monomer units satisfying the requirements of the first monomer unit, and a monomer unit B with an SP value of $SP_{112}$ is included in (100−A) mol % based on the number of moles of all the monomer units satisfying the requirements of the first monomer unit is $$SP_{11}=(SP_{111}\times A+SP_{112}\times(100-A))/100.$$

The same calculation is also performed when there are three or more monomer units satisfying the requirements of the first monomer unit. Meanwhile, $SP_{12}$ similarly represents the average value calculated by the molar ratio of respective first polymerizable monomers.

Meanwhile, the monomer unit derived from the second polymerizable monomer corresponds to all monomer units having $SP_{21}$ satisfying the formula (1) with respect to $SP_{11}$ calculated by the above method. Similarly, the second polymerizable monomer corresponds to all polymerizable monomers having $SP_{22}$ satisfying the formula (4) with respect to $SP_{12}$ calculated by the above method.

That is, when the second polymerizable monomer is two or more kinds of polymerizable monomers, $SP_{21}$ represents the SP value of the monomer unit derived from each of the polymerizable monomers, and $SP_{21}$—$SP_{11}$ is determined with respect to the monomer unit derived from each second polymerizable monomer. Similarly, $SP_{22}$ represents the SP value of each polymerizable monomer, and $SP_{22}$–$SP_{12}$ is determined with respect to each second polymerizable monomer.

<Polyvalent Metal>

The polymer A includes a polyvalent metal, and the polyvalent metal is at least one selected from the group consisting of Mg, Ca, Al, and Zn. By including such a polyvalent metal, the polyvalent metal can be oriented to the polar portion to form a network-shaped crosslinking that contributes to the suppression of the development stripes. As a result, it is possible to obtain a toner excellent in the effect of suppressing the development stripes.

Meanwhile, when the polyvalent metal does not include at least one selected from the group consisting of Mg, Ca, Al, and Zn, or when a polyvalent metal having a large atomic weight such as Sr or Ba is selected, the number of crosslinking points with respect to the amount of the polyvalent metal added is reduced, and the crosslinking formation effect is reduced. As a result, the effect of suppressing the development stripes and the charge retention property are poor.

Further, the content of the polyvalent metal in the toner particle is 25 ppm to 500 ppm on a mass basis. When the content of the polyvalent metal in the toner particle is within the above range, the crosslinked portion of the second monomer unit and the polyvalent metal becomes appropriate, and it is possible to form an appropriate crosslinked portion that does not inhibit the low-temperature fixability and charge retention property, while demonstrating the effect of suppressing the development stripes.

Meanwhile, when the content of the polyvalent metal in the toner particle is less than 25 ppm, the number of crosslinking points between the polar portion and the polyvalent metal is too small, and the effect of suppressing the development stripes and the charge retention property are poor. Where the content of the polyvalent metal in the toner particle is more than 500 ppm, the low-temperature fixability is poor. Furthermore, since the amount of the monovalent metal to be described later is relatively reduced, the crosslinking with the polyvalent metal is dominant in the crosslinking of the polar portion, and because the number of crosslinking points is reduced, the effect of suppressing the development stripes and the charge retention property are poor.

The content of the polyvalent metal in the toner particles is preferably 300 ppm to 400 ppm.

Further, it is preferable that the amount of the polyvalent metal in the toner particle and the content of the second monomer unit in the polymer A satisfy the following formula (3).

$$(\text{Content of polyvalent metal in toner particle})/(\text{Content of second monomer unit in polymer } A) \geq 0.5 \ (\text{ppm/mol \%}) \quad (3)$$

In the toner according to the second aspect, it is preferable that the amount of the polyvalent metal in the toner particle and the content of the second polymerizable monomer in the composition satisfy the following formula (6).

$$(\text{Content of polyvalent metal in toner particle})/(\text{Content of second polymerizable monomer in composition}) \geq 0.5 \ (\text{ppm/mol \%}) \quad (6)$$

As a result of satisfying the formula (3) or formula (6), the ratio of the polyvalent metal and the polar portion falls in the range optimal for crosslinking formation, and the effect of suppressing the development stripes and excellent charge retention property are obtained.

The (Content of polyvalent metal in toner particle)/(Content of second monomer unit in polymer A) or the (Content of polyvalent metal in toner particle)/(Content of second polymerizable monomer in composition) is preferably 0.6 ppm/mol % to 1.0 ppm/mol %.

Further, in the concentration distribution of the polyvalent metal in the cross section of the toner particle, the polyvalent metal concentration in the region from the surface of the toner particle to the depth of 0.4 μm (hereinafter also referred to as "toner particle surface layer") is preferably lower than the polyvalent metal concentration in the region deeper than 0.4 μm from the surface of the toner particle (hereinafter, also referred to as "toner particle inner portion"). Specifically, it is preferable that the following formula (7) be satisfied, and it is more preferable that the following formula (8) be satisfied.

$$(\text{Polyvalent metal concentration in the toner particle surface layer})/(\text{Polyvalent metal concentration in the toner particle inner portion}) < 1 \quad (7)$$

$$(\text{Polyvalent metal concentration in the toner particle surface layer})/(\text{Polyvalent metal concentration in the toner particle inner portion}) \leq 0.5 \quad (8)$$

When the polyvalent metal concentration in the toner particle surface layer is lower than the polyvalent metal concentration in the toner particle inner portion, the number of crosslinked portions between the polar portion and the polyvalent metal inside the toner particle is increased, and excellent effect of suppressing the development stripes is obtained. Furthermore, since the number of non-crosslinked segments contributing to crystallinity increases in the toner particle surface layer, excellent low-temperature fixability is demonstrated.

The concentration distribution of the polyvalent metal in the toner particle can be controlled by a metal removal step described hereinbelow. The concentration distribution of the polyvalent metal in the toner particle is determined by mapping image analysis of the below-described toner particle cross section performed with energy dispersive X-ray spectrometer (EDX) of a scanning electron microscope (SEM).

The polymer A preferably includes a monovalent metal, and the monovalent metal is preferably at least one selected from the group consisting of Na, Li, and K. By including such a monovalent metal, the polar portion in the polymer A can form not only the crosslinking between the polar portion and the polyvalent metal but also the crosslinked portion between the polar portion and the monovalent metal. Therefore, the toner is excellent in the effect of suppressing the development stripes and the low-temperature fixability.

The amount of the monovalent metal is preferably 50% by mass to 90% by mass based on the total of the amount of the polyvalent metal and the amount of the monovalent metal. When the amount of the monovalent metal is within the above range, the domain phase consisting of the crosslinked portion of the polar portion and the polyvalent metal and the domain phase consisting of the crosslinked portion of the polar portion and the monovalent metal are more appropriately formed in the toner particle, and an appropriate domain matrix structure which does not inhibit the low-temperature fixability can be formed while demonstrating the effect of suppressing the development stripes and the charge retention property.

The amount of the monovalent metal is more preferably 60% by mass to 90% by mass based on the total of the amount of the polyvalent metal and the amount of the monovalent metal.

The complex elastic modulus at 65° C. of the toner is preferably $1.0\times10^7$ Pa to $5.0\times10^7$ Pa, and the complex elastic modulus at 85° C. is preferably $1.0\times10^5$ Pa or less. When the complex elastic modulus at 65° C. is $1.0\times10^5$ Pa to $5.0\times10^7$ Pa, crosslinking of the polar portion and at least one of the polyvalent metal and the monovalent metal is preferably formed, and superior effect of suppressing the development stripes and charge retention property can be demonstrated. Further, when the complex elastic modulus at 85° C. is $1.0\times10^5$ Pa or less, the crosslinking between the polar portion and at least one of the polyvalent metal and the monovalent metal assumes an appropriate strength that is loosened when the melting point is exceeded and a superior low-temperature fixability can be demonstrated.

The complex elastic modulus at 65° C. of the toner is preferably $2.0\times10^7$ Pa to $4.0\times10^7$ Pa. Further, the complex elastic modulus at 85° C. of the toner is preferably $9.5\times10^4$ Pa or less.

The domain diameter of at least one of the polyvalent metal and the monovalent metal determined by mapping image analysis of the toner particle cross section performed with energy dispersive X-ray spectrometer (EDX) of a scanning electron microscope (SEM) is preferably 10 nm to 50 nm. The method for measuring the domain diameter of at least one of the polyvalent metal and the monovalent metal will be described hereinbelow.

When the domain diameter is in the above range, a micro-phase-separated state caused by the difference in polarity between the monomer units is advantageously formed. As a result, the non-crosslinked portion contributing to the low-temperature fixability and the charge retention property and the crosslinked portion contributing to the effect of suppressing the development stripes can be made to be present in a domain matrix form. Therefore, it is possible to obtain the toner with superior low-temperature fixability, effect of suppressing the development stripes, and charge retention property. The domain diameter can be adjusted by the type and amount of the second monomer unit.

The domain diameter is more preferably 30 nm to 50 nm.

Such a micro-phase-separated state can be observed by marking at least one of the polyvalent metal and the monovalent metal oriented to the polar portion and observing it with an SEM.

The polymer may include a third monomer unit derived from a third polymerizable monomer, which is not included in the range of the formula (1) or (2) (that is, a polymerizable monomer different from the first polymerizable monomer and the second polymerizable monomer), in an amount such that does not impair the above-described molar ratio of the first monomer unit derived from the first polymerizable monomer and the second monomer unit derived from the second polymerizable monomer.

Among the monomers exemplified as the second polymerizable monomer, those that do not satisfy the formula (1) or the formula (2) can be used as the third polymerizable monomer.

It is also possible to use the following monomers. For example, styrene and derivatives thereof such as styrene, o-methylstyrene, and the like, and (meth)acrylic acid esters such as methyl (meth)acrylate, n-butyl (meth)acrylate, t-butyl (meth)acrylate, 2-ethylhexyl (meth)acrylate and the like. In addition, when the formula (1) or the formula (2) is satisfied, such monomers can be used as the second polymerizable monomer.

The third polymerizable monomer is preferably at least one selected from the group consisting of styrene, methyl methacrylate and methyl acrylate in order to improve the storability of the toner.

The acid value of the polymer A is preferably 30.0 mg KOH/g or less, and more preferably 20.0 mg KOH/g or less.

When the acid value is in the above range, the hygroscopicity in a high-temperature and high-humidity environment is low, so that excellent charge retention property can be exhibited. The lower limit of the acid value is not particularly limited, but is preferably 0 mg KOH/g or more.

The polymer A preferably has a weight-average molecular weight (Mw) of tetrahydrofuran (THF) insolubles from 10,000 to 200,000, and more preferably from 20,000 to 150,000 as measured by gel permeation chromatography (GPC). When the Mw is in the above range, elasticity at around room temperature can be easily maintained.

The polymer A preferably has a melting point from 50° C. to 80° C., and more preferably from 53° C. to 70° C. When the melting point of the polymer A is in the above range, superior low-temperature fixability is exhibited.

The melting point of the polymer A can be adjusted by the type and amount of the first polymerizable monomer and the type and amount of the second polymerizable monomer to be used, and the like.

The polymer A is preferably a vinyl polymer. The vinyl polymer can be exemplified by polymers of monomers including an ethylenically unsaturated bond. The ethylenically unsaturated bond refers to a carbon-carbon double bond capable of radical polymerization, and examples thereof include a vinyl group, a propenyl group, an acryloyl group, a methacryloyl group and the like.

<Resins Other than Polymer A>

The binder resin may also include, if necessary, a resin other than the polymer A. The resin other than the polymer A to be used for the binder resin can be exemplified by the following resins.

Homopolymers of styrene and substitution products thereof such as polystyrene, poly-p-chlorostyrene, polyvinyl toluene, and the like; styrene copolymers such as styrene—p-chlorostyrene copolymer, styrene—vinyl toluene copolymer, styrene—vinyl naphthalene copolymer, styrene—acrylic acid ester copolymer, styrene—methacrylic acid ester copolymer, styrene—α-chloromethyl methacrylate copolymer, styrene—acrylonitrile copolymer, styrene—vinyl methyl ether copolymer, styrene—vinyl ethyl ether copolymer, styrene—vinyl methyl ketone copolymer, styrene—acrylonitrile—indene copolymer; polyvinyl chloride, phenolic resins, natural resin-modified phenolic resins, natural resin-modified maleic resins, acrylic resins, methacrylic resins, polyvinyl acetate, silicone resins, polyester resins, polyurethane resins, polyamide resins, furan resins, epoxy resins, xylene resins, polyvinyl butyral, terpene resins, coumarone—indene resins, petroleum resins, and the like.

Among these, styrene copolymers and polyester resins are preferable. Moreover, it is preferable that resin other than the polymer A be amorphous.

In addition, when the amount of the polymer A in the binder resin is 50.0% by mass or more, excellent low-temperature fixability can be exhibited. More preferably, this amount is 80.0% by mass to 100.0% by mass, and it is more preferably that the binder resin be the polymer A.

<Release Agent>

The toner particle may include a wax as a release agent. Examples of such a wax are presented hereinbelow.

Hydrocarbon waxes such as low-molecular-weight polyethylene, low-molecular-weight polypropylene, alkylene copolymers, microcrystalline wax, paraffin wax, Fischer-Tropsch wax, and the like; oxides of hydrocarbon waxes, such as oxidized polyethylene wax, or block copolymer thereof; waxes based on fatty acid esters such as carnauba wax; and partially or entirely deoxidized fatty acid esters such as deoxidized carnauba wax. Saturated linear fatty acids such as palmitic acid, stearic acid, and montanic acid; unsaturated fatty acids such as brashidic acid, eleostearic acid, and valinaric acid; saturated alcohols such as stearyl alcohol, aralkyl alcohol, behenyl alcohol, carnaubyl alcohol, ceryl alcohol, and myricyl alcohol; polyhydric alcohols such as sorbitol; esters of fatty acids such as palmitic acid, stearic acid, behenic acid, and montanic acid with alcohols such as stearyl alcohol, aralkyl alcohol, behenyl alcohol, carnaubyl alcohol, ceryl alcohol, and myricyl alcohol; fatty acid amides such as linoleic acid amide, oleic acid amide and lauric acid amide; saturated fatty acid bisamides such as methylene bis-stearic acid amide, ethylene bis-capric acid amide, ethylene bis-lauric acid amide, and hexamethylene bis-stearic acid amide; unsaturated fatty acid amides such as ethylene bis-oleic acid amide, hexamethylene bis-oleic acid amide, N,N'-dioleyl adipic acid amide, and N,N'-dioleyl sebacic acid amide; aromatic bisamides such as m-xylene bis-stearic acid amide and N,N'-distearyl isophthalic acid amide; aliphatic metal salts such as calcium stearate, calcium laurate, zinc stearate, and magnesium stearate (generally referred to as metal soaps); waxes obtained by grafting vinyl monomers such as styrene and acrylic acid onto aliphatic hydrocarbon waxes; partial esterification products of fatty acids and polyhydric alcohols such as monoglyceride behenate; and methyl ester compounds having a hydroxyl group obtained by hydrogenation of vegetable fats and oils.

Among these waxes, hydrocarbon waxes such as paraffin waxes and Fischer-Tropsch wax, and fatty acid ester waxes such as carnauba wax are preferable from the viewpoint of improving the low-temperature fixability and fixation separability. Hydrocarbon waxes are more preferable in that the hot offset resistance is further improved.

The amount of the wax is preferably 3 parts by mass to 8 parts by mass with respect to 100 parts by mass of the binder resin.

The peak temperature of the maximum endothermic peak of the wax in the endothermic curve at the time of temperature rise measured with a differential scanning calorimetry (DSC) device is preferably 45° C. to 140° C. When the peak temperature of the maximum endothermic peak of the wax is in the above range, both the storability and the hot offset resistance of the toner can be achieved.

<Colorant>

The toner may include a colorant, if necessary. Examples of the colorant are presented hereinbelow.

Examples of the black colorant include carbon black and colorants toned in black by using a yellow colorant, a magenta colorant and a cyan colorant. A pigment may be used alone, and a dye and a pigment may be used in combination as the colorant. It is preferable to use a dye and a pigment in combination from the viewpoint of image quality of a full-color image.

Examples of pigments for a magenta toner are presented hereinbelow. C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, 282; C.I. Pigment Violet 19; and C.I. Vat Red 1, 2, 10, 13, 15, 23, 29, 35.

Examples of dyes for a magenta toner are presented hereinbelow. C.I. Solvent Red 1, 3, 8, 23, 24, 25, 27, 30, 49, 81, 82, 83, 84, 100, 109, 121; C.I. Disperse Red 9; C.I. Solvent Violet 8, 13, 14, 21, 27; oil-soluble dyes such as C.I. Disperse Violet 1; C.I. Basic Red 1, 2, 9, 12, 13, 14, 15, 17, 18, 22, 23, 24, 27, 29, 32, 34, 35, 36, 37, 38, 39, 40; and basic dyes such as C.I. Basic Violet 1, 3, 7, 10, 14, 15, 21, 25, 26, 27, 28.

Examples of pigments for a cyan toner are presented hereinbelow. C.I. Pigment Blue 2, 3, 15:2, 15:3, 15:4, 16, 17; C.I. Vat Blue 6; C.I. Acid Blue 45 and copper phthalocyanine pigments in which 1 to 5 phthalimidomethyl groups are substituted in a phthalocyanine skeleton.

C.I. Solvent Blue 70 is an example of a dye for a cyan toner.

Examples of pigments for a yellow toner are presented hereinbelow. C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, 185; and C.I. Vat Yellow 1, 3, 20.

C.I. Solvent Yellow 162 is an example of a dye for a yellow toner.

These colorants can be used singly or in a mixture, or in the form of a solid solution. The colorant is selected from the standpoint of hue angle, saturation, lightness, light resistance, OHP transparency, and dispersibility in the toner.

The amount of the colorant is preferably 0.1 parts by mass to 30.0 parts by mass with respect to the total amount of the resin components.

<Charge Control Agent>

The toner particle may optionally include a charge control agent. By blending a charge control agent, it becomes possible to stabilize the charge characteristic and to control the optimum triboelectric charge quantity according to the development system.

As the charge control agent, known ones can be used, but in particular, metal compounds of aromatic carboxylic acids which are colorless, can accelerate the charging speed of the toner and can stably hold a constant charge quantity are preferable.

Examples of negatively charging control agents include metal compounds of salicylic acid, metal compounds of naphthoic acid, metal compounds of dicarboxylic acids, polymeric compounds having a sulfonic acid or a carboxylic acid in a side chain, polymeric compounds having a sulfonic acid salt or a sulfonic acid ester compound in a side chain, polymeric compounds having a carboxylic acid salt or a carboxylic acid ester compound in a side chain, boron compounds, urea compounds, silicon compounds, and calixarenes.

The charge control agent may be internally or externally added to the toner particle. The amount of the charge control agent is preferably 0.2 parts by mass to 10.0 parts by mass, and more preferably 0.5 parts by mass to 10.0 parts by mass with respect to 100 parts by mass of the binder resin.

<Inorganic Fine Particle>

The toner may include inorganic fine particles, if necessary.

The inorganic fine particle may be internally added to the toner particle, or may be mixed with the toner as an external additive. Examples of the inorganic fine particles include fine particles such as silica fine particles, titanium oxide fine particles, alumina fine particles or fine particles of complex oxides thereof. Among the inorganic fine particles, silica fine particles and titanium oxide fine particles are preferable from the standpoint of flowability improvement and charge uniformity.

The inorganic fine particles are preferably hydrophobized with a hydrophobizing agent such as a silane compound, silicone oil or a mixture thereof.

From the viewpoint of flowability improvement, the inorganic fine particles as the external additive preferably have a specific surface area of 50 $m^2/g$ to 400 $m^2/g$. From the viewpoint of improving the durability stability, the inorganic fine particles as the external additive preferably have a specific surface area of 10 $m^2/g$ to 50 $m^2/g$. In order to ensure both the flowability improvement and the durability stability, inorganic fine particles with the specific surface area in these ranges may be used in combination.

The amount of the external additive is preferably 0.1 parts by mass to 10.0 parts by mass with respect to 100 parts by mass of the toner particles. A known mixer such as a Henschel mixer can be used to mix the toner particles with the external additive.

<Developer>

The toner can be used as a one-component developer, but is preferably used as a two-component developer by mixing with a magnetic carrier in order to further improve dot reproducibility and to provide stable images over a long period of time.

Examples of the magnetic carrier include such well-known materials as iron oxide; metal particles such as iron, lithium, calcium, magnesium, nickel, copper, zinc, cobalt, manganese, chromium, and rare earths, alloy particles thereof, and oxide particles thereof; magnetic bodies such as ferrites; magnetic body-dispersed resin carriers (so-called resin carriers) including the magnetic bodies and a binder resin that holds the magnetic bodies in a dispersed state, and the like.

When the toner is used as a two-component developer by mixing with a magnetic carrier, the mixing ratio of the magnetic carrier at that time is preferably 2% by mass to 15% by mass and more preferably 4% by mass to 13% by mass as the toner concentration in the two-component developer.

<Method for Producing Toner>

A method for producing the toner of the present invention is not particularly limited, and known methods such as a pulverization method, a suspension polymerization method, a dissolution suspension method, an emulsion aggregation method, and a dispersion polymerization method can be used.

Here, the toner of the present invention is preferably produced by the following method. Thus, the toner of the present invention is preferably produced by an emulsion aggregation method.

A method for producing a toner includes:

a step of preparing a resin fine particle-dispersed solution including a binder resin;

a step of adding a flocculant to the resin fine particle-dispersed solution to form aggregated particles; and a step of heating and fusing the aggregated particles to obtain a dispersion solution including toner particles, wherein the binder resin includes a polymer A, the polymer A is a polymer of a composition including:

a first polymerizable monomer, and a second polymerizable monomer different from the first polymerizable monomer;

the first polymerizable monomer is at least one selected from the group consisting of (meth)acrylic acid esters having an alkyl group having 18 to 36 carbon atoms;

a content of the first polymerizable monomer in the composition is 5.0 mol % to 60.0 mol %, based on the total number of moles of all the polymerizable monomers in the composition;

a content of the second polymerizable monomer in the composition is 20.0 mol % to 95.0 mol %, based on the total number of moles of all the polymerizable monomers in the composition;

where an SP value of the first polymerizable monomer is denoted by $SP_{12}$ $(J/cm^3)^{0.5}$ and an SP value of the second polymerizable monomer is denoted by $SP_{22}$ $(J/cm^3)^{0.5}$, the formulas (4) and (5) above are satisfied;

the flocculant includes a polyvalent metal;

the polyvalent metal is at least one selected from the group consisting of Mg, Ca, Al, and Zn; and a content of the polyvalent metal in the toner particle is 25 ppm to 500 ppm on a mass basis.

In the case of the abovementioned production method, two or more types of monomer units that differ greatly in polarity form a micro-phase-separated state in the toner particle. The polyvalent metal is oriented to the polar portion, and a crosslinking between the polyvalent metal and the polar portion is formed. As a result, the non-crosslinked portion that contributes to the low-temperature fixability and the charge retention property and the crosslinked portion that contributes to the effect of suppressing the development stripes can be formed in a network shape throughout the toner particle while forming a domain matrix structure in which the domain phase consisting of the crosslinked portion is dispersed in the matrix phase consisting of the non-crosslinked portion. Therefore, it is possible to obtain a toner which is excellent in the low-temperature fixability, the effect of suppressing the development stripes under a high-temperature and high-humidity environment, and the charge retention property.

<Emulsion Aggregation Method>

In the emulsion aggregation method, an aqueous dispersion solution of fine particles which are sufficiently smaller than the desired particle size and consist of a constituent material of toner particles is prepared in advance, the fine particles are aggregated to the particle size of toner particles in an aqueous medium, and the resin is fused by heating or the like to produce toner particles.

That is, in the emulsion aggregation method, toner particles are produced through a dispersion step of preparing a fine particle-dispersed solution consisting of the constituent material of the toner particles, an aggregation step of aggregating the fine particles consisting of the constituent material of the toner particles, and controlling the particle diameter until the particle diameter of the toner particles is obtained, a fusion step of fusing the resin contained in the obtained aggregated particles, a subsequent cooling step, a metal removal step of filtering off the obtained toner and removing excess polyvalent metal ions, a filtration and washing step of washing with ion exchanged water or the like, and a step of removing moisture of the washed toner particles and drying.

In the emulsion aggregation method, the step of contacting the toner particles with an organic solvent and the separation step correspond to a step of treating the wet cake of toner particles obtained in the filtration and washing step with an organic solvent, or a step of treating the toner particles finally obtained through the drying step with an organic solvent.

<Step of Preparing Resin Fine Particle-Dispersed Solution (Dispersion Step)>

The resin fine particle-dispersed solution can be prepared by known methods, but is not limited to these methods. Examples of the known methods include an emulsion polymerization method, a self-emulsification method, a phase inversion emulsification method of emulsifying a resin by adding an aqueous medium to a resin solution obtained by dissolving the resin in an organic solvent, and a forced emulsification method in which the resin is forcedly emulsified by high-temperature treatment in an aqueous medium, without using an organic solvent.

Specifically, a binder resin is dissolved in an organic solvent that can dissolve the resin, and a surfactant or a basic compound is added. At that time, where the binder resin is a crystalline resin having a melting point, the resin may be dissolved by melting to a temperature higher than the melting point. Subsequently, an aqueous medium is slowly added to precipitate resin fine particles while stirring with a homogenizer or the like. Thereafter, the solvent is removed by heating or depressurizing to prepare a resin fine particle-dispersed aqueous solution. Any organic solvent that can dissolve the resin can be used as the organic solvent for dissolving the resin, but an organic solvent which forms a homogeneous phase with water, such as toluene, is preferable from the viewpoint of suppressing the generation of coarse powder.

A surfactant to be used at the time of the emulsification is not particularly limited, and examples thereof include anionic surfactants such as sulfuric acid esters, sulfonic acid salts, carboxylic acid salts, phosphoric acid esters, soaps and the like; cationic surfactants such as amine salts, quaternary ammonium salts and the like; and nonionic surfactants such as polyethylene glycol, alkylphenol ethylene oxide adducts, polyhydric alcohols and the like. The surfactants may be used singly or in combination of two or more thereof.

Examples of the basic compound to be used in the dispersion step include inorganic bases such as sodium hydroxide, potassium hydroxide and the like, and organic bases such as ammonia, triethylamine, trimethylamine, dimethylaminoethanol, diethylaminoethanol and the like. The basic compounds may be used singly or in combination of two or more thereof.

The 50% particle diameter (D50), based on the volume distribution, of the fine particles of the binder resin in the resin fine particle-dispersed aqueous solution is preferably 0.05 μm to 1.0 μm, and more preferably 0.05 μm to 0.4 μm. By adjusting the 50% particle diameter (D50) based on the volume distribution to the above range, it is easy to obtain toner particles with a volume average particle diameter of 3 μm to 10 μm which is suitable for toner particles.

A dynamic light scattering type particle size distribution analyzer NANOTRAC UPA-EX150 (manufactured by Nikkiso Co., Ltd.) is used for measurement of the 50% particle size (D50) based on the volume distribution.

<Colorant Fine Particle-Dispersed Solution>

The colorant fine particle-dispersed solution, which is used as necessary, can be prepared by the known methods listed below, but is not limited to these methods.

The colorant fine particle-dispersed solution can be prepared by mixing a colorant, an aqueous medium and a dispersing agent by using a mixer such as a known stirrer, emulsifier, and disperser. The dispersing agent used here may be a known one such as a surfactant and a polymer dispersing agent.

Although any of the surfactant and the polymer dispersing agent can be removed in the washing step described hereinbelow, the surfactant is preferable from the viewpoint of washing efficiency.

Examples of the surfactant include anionic surfactants such as sulfuric acid esters, sulfonic acid salts, carboxylic acid salts, phosphoric acid esters, soaps and the like; cationic surfactants such as amine salts, quaternary ammonium salts and the like; and nonionic surfactants such as polyethylene glycol, alkylphenol ethylene oxide adducts, polyhydric alcohols and the like.

Among these, nonionic surfactants and anionic surfactants are preferable. Moreover, a nonionic surfactant and an anionic surfactant may be used together. The surfactants may be used singly or in combination of two or more thereof. The concentration of the surfactant in the aqueous medium is preferably 0.5% by mass to 5% by mass.

The amount of the colorant fine particles in the colorant fine particle-dispersed solution is not particularly limited, but is preferably 1% by mass to 30% by mass with respect to the total mass of the colorant fine particle-dispersed solution.

In addition, from the viewpoint of dispersibility of the colorant in the finally obtained toner, the dispersed particle diameter of the colorant fine particles in the colorant fine particle-dispersed aqueous solution is preferably such that the 50% particle diameter (D50) based on the volume distribution is 0.5 μm or less. Further, for the same reason, it is preferable that the 90% particle size (D90) based on the volume distribution be 2 μm or less. The dispersed particle diameter of the colorant particles dispersed in the aqueous medium is measured by a dynamic light scattering type particle size distribution analyzer (NANOTRAC UPA-EX150: manufactured by Nikkiso Co., Ltd.).

Known mixers such as stirrers, emulsifiers, and dispersers used for dispersing colorants in aqueous media include ultrasonic homogenizers, jet mills, pressure homogenizers, colloid mills, ball mills, sand mills, and paint shakers. These may be used singly or in combination.

<Release Agent (Aliphatic Hydrocarbon Compound) Fine Particle-Dispersed Solution>

A release agent fine particle-dispersed solution may be used as necessary. The release agent fine particle-dispersed solution can be prepared by the following known methods, but is not limited to these methods.

The release agent fine particle-dispersed solution can be prepared by adding a release agent to an aqueous medium including a surfactant, heating to a temperature equal to or higher than the melting point of the release agent, dispersing to a particulate shape with a homogenizer having a strong shearing ability (for example, "CLEARMIX W MOTION" manufactured by M Technique Co., Ltd.) or a pressure discharge type disperser (for example, a "GAULIN HOMOGENIZER" manufactured by Gaulin Co., Ltd.) and then cooling to below the melting point.

The dispersed particle diameter of the release agent fine particle-dispersed solution in the release agent-dispersed aqueous solution is preferably such that the 50% particle diameter (D50) based on volume distribution is 0.03 μm to 1.0 μm, and more preferably, 0.1 μm to 0.5 μm. In addition, it is preferable that coarse particles of 1 μm or more be not present.

When the dispersed particle diameter of the release agent fine particle-dispersed solution is within the above range, the release agent can be finely dispersed to be present in the toner, the seeping effect at the time of fixing can be maximized, and it is possible to obtain good separability. The dispersed particle diameter of the release agent fine particle-dispersed solution obtained by dispersion in an aqueous medium can be measured with a dynamic light scattering type particle size distribution analyzer (NANOTRAC UPA-EX 150: manufactured by Nikkiso Co., Ltd.).

<Mixing Step>

In the mixing step, a mixed liquid is prepared by mixing, if necessary, the resin fine particle-dispersed solution with at least one of the release agent fine particle-dispersed solution and the colorant fine particle-dispersed solution. The mixing can be carried out using a known mixing device such as a homogenizer and a mixer.

<Step of Forming Aggregated Particles (Aggregation Step)>

In the aggregation step, fine particles contained in the mixed liquid prepared in the mixing step are aggregated to form aggregates having a target particle diameter. At this time, a flocculant is added and mixed, and if necessary, at least one of heating and mechanical power is appropriately added to form aggregates in which fine resin particles and, if necessary, at least one of the release agent fine particles and the colorant fine particles are aggregated.

The flocculant is a flocculant including metal ions of a polyvalent metal, and the polyvalent metal is at least one selected from the group consisting of Mg, Ca, Al, and Zn.

The flocculant including metal ions of the polyvalent metal has high aggregating power, and it is possible to achieve the purpose by adding a small amount thereof. Such flocculants can ionically neutralize the ionic surfactant contained in the resin fine particle-dispersed solution, the release agent fine particle-dispersed solution, and the colorant fine particle-dispersed solution. As a result, the binder resin fine particles, the release agent fine particles, and the colorant fine particles are aggregated by the salting out and ionic crosslinking effects. Furthermore, the flocculant including the metal ions of the polyvalent metal can form a crosslink with the polymer. As a result, the crosslinking points of the polyvalent metal and the polar portion of the toner particle can be formed in a network shape throughout the toner particle while forming a domain matrix structure. Therefore, excellent charge retention property can be demonstrated without impairing the low-temperature fixability, and the development stripes can be suppressed.

The flocculant including metal ions of a polyvalent metal can be exemplified by metal salts of polyvalent metals and polymers of the metal salts. Specific examples include divalent inorganic metal salts such as calcium chloride, calcium nitrate, magnesium chloride, magnesium sulfate and zinc chloride. Other examples include trivalent metal salts such as iron (III) chloride, iron (III) sulfate, aluminum sulfate, and aluminum chloride. In addition, inorganic metal salt polymers such as polyaluminum chloride, polyaluminum hydroxide and calcium polysulfide may be mentioned, but these examples are not limiting. These may be used singly or in combination of two or more thereof.

The flocculant may be added in the form of a dry powder or an aqueous solution obtained by dissolving in an aqueous medium, but in order to cause uniform aggregation, the flocculant is preferably added in the form of an aqueous solution.

Moreover, it is preferable to perform addition and mixing of the flocculant at a temperature equal to or lower than the glass transition temperature or melting point of the resin contained in a mixed liquid. By performing mixing under such temperature condition, the aggregation proceeds relatively uniformly. The mixing of the flocculant into the mixed liquid can be carried out using known mixing devices such as homogenizers and mixers. The aggregation step is a step of forming aggregates of a toner particle size in an aqueous medium. The volume average particle size of the aggregates produced in the aggregation step is preferably 3 μm to 10 μm. The volume average particle diameter can be measured by a particle size distribution analyzer (Coulter Multisizer III: manufactured by Beckman Coulter, Inc.) by the Coulter method.

<Step of Obtaining Dispersion solution Including Toner Particles (Fusion Step)>

In the fusion step, an aggregation stopper is added to the dispersion solution including the aggregates obtained in the aggregation step under stirring similar to that in the aggregation step. The aggregation stopper can be exemplified by a chelating agent that stabilizes aggregated particles by partially dissociating the ionic crosslinks between the acidic polar group of the surfactant and the metal ion that is the flocculant and forming a coordination bond with the metal ion. By adding the aggregation stopper, it is possible to control the crosslinking points between the polar portion of the toner particle and the polyvalent metal to an optimum amount, so that the excellent effect of suppressing the development stripes and the excellent charge retention property can be exhibited without impairing the low-temperature fixability.

After the dispersion state of the aggregated particles in the dispersion solution has been stabilized by the action of the aggregation stopper, the aggregated particles are fused by heating to a temperature equal to or higher than the glass transition temperature or melting point of the binder resin.

The chelating agent is not particularly limited as long as it is a known water-soluble chelating agent. Specific examples include hydroxycarboxylic acids such as tartaric acid, citric acid and gluconic acid, and sodium salts thereof; iminodiacid (IDA), nitrilotriacetic acid (NTA), and ethylenediaminetetraacetic acid (EDTA), and sodium salts of these acids.

The chelating agent is coordinated to the metal ion of the flocculant present in the dispersion solution of the aggregated particles, so that the environment in the dispersion solution can be changed from an electrostatically unstable state in which aggregation can easily occur to an electrostatically stable state in which further aggregation is unlikely to occur. As a result, it is possible to suppress further aggregation of the aggregated particles in the dispersion solution and to stabilize the aggregated particles.

The chelating agent is preferably an organic metal salt having a carboxylic acid having a valency of 3 or more, since even small amounts of such chelating agent can be effective and toner particles having a sharp particle size distribution can be obtained.

Further, from the viewpoint of achieving both stabilization from the aggregation state and washing efficiency, the addition amount of the chelating agent is preferably 1 part by mass to 30 parts by mass and more preferably 2.5 parts by mass to 15 parts by mass with respect to 100 parts by mass of the binder resin. The volume-based 50% particle diameter (D50) of the toner particles is preferably 3 μm to 10 μm.

<Cooling Step>

If necessary, in the cooling step, the temperature of the dispersion solution including the toner particles obtained in the fusion step can also be reduced to a temperature lower than at least one of the crystallization temperature and glass transition temperature of the binder resin. By cooling to a temperature lower than at least one of the crystallization temperature and glass transition temperature, it is possible to prevent the generation of coarse particles. The specific cooling rate can be 0.1° C./min to 50° C./min.

<Metal Removal Step>

Further, it is preferable that the toner production method include a metal removal step of removing a metal by adding a chelating compound having a chelating ability with respect to metal ions to the dispersion solution including toner particles. With the metal removal step, it is possible to control the concentration distribution of the polyvalent metal in the toner particle cross section. Specifically, since the polyvalent metal concentration in the toner particle surface layer can be made lower than the polyvalent metal concentration in the toner particle inner portion, excellent effect of suppressing the development stripes and charge retention property are exhibited without impairing the low-temperature fixability.

The chelating compound is not particularly limited as long as it is a known water-soluble chelating agent, and the aforementioned chelating agents can be used. Since the metal removal performance of water-soluble chelating agents is very sensitive to temperature, the metal removal step is preferably performed at 40° C. to 60° C., and more preferably at about 50° C.

<Washing Step>

If necessary, impurities in the toner particles can be removed by repeating the washing and filtration of the toner particles obtained in the cooling step in the washing step. Specifically, it is preferable to wash the toner particles by using an aqueous solution including a chelating agent such as ethylenediaminetetraacetic acid (EDTA) and a Na salt thereof, and further wash with pure water. By repeating washing with pure water and filtration a plurality of times, metal salts and surfactants in the toner particles can be removed. The number of filtrations is preferably 3 to 20 and more preferably 3 to 10 from the viewpoint of production efficiency.

<Drying Step>

In the drying step, if necessary, the toner particles obtained in the above step are dried.

<External Addition Step>

In the external addition step, if necessary, inorganic fine particles are externally added to the toner particles obtained in the drying step. Specifically, it is preferable to add inorganic fine particles such as silica or resin fine particles of a vinyl resin, a polyester resin, or a silicone resin while applying a shear force in a dry state.

Methods for measuring various physical properties of toner particles and raw materials will be described hereinbelow.

<Method for Measuring Amount of Metals in Toner Particle>

The amount of metals in the toner particle is measured using a multi-element simultaneous ICP emission spectrophotometer Vista-PRO (manufactured by Hitachi High-Tech Science Co., Ltd.).

Sample: 50 mg

Solvent: 6 mL of nitric acid

The above materials are weighed, and decomposition processing is performed using a microwave sample pretreatment device ETHOS UP (manufactured by Milestone General Co., Ltd.).

Temperature: raised from 20° C. to 230° C. and held at 230° C. for 30 min.

The decomposition solution is passed through filter paper (5C), transferred to a 50 mL volumetric flask, and made up to 50 mL with ultrapure water. The amount of polyvalent metal elements (such as Mg, Ca, Al, and Zn) and monovalent metal elements (Na, Li and K) in the toner particle can be quantified by measuring the aqueous solution in the volumetric flask under the following conditions with the multi-element simultaneous ICP emission spectrophotometer Vista-PRO. For quantification of the amount, a calibration curve is prepared using a standard sample of the element to be quantified, and the calculation is performed based on the calibration curve.

Condition: RF power 1.20 kW,

Ar gas: plasma flow 15.0 L/min,

Auxiliary flow: 1.50 L/min,

MFC: 1.50 L/min,

Nevizer Flow: 0.90 L/min,

Pump speed: 15 rpm,

Measurement repetition: 3 times,

Measurement time: 1.0 s (The case of measuring a toner to which inorganic fine particles including at least one metal selected from the group consisting of Mg, Ca, Al, and Zn were externally added)

When measuring the amount of metal in the toner particle of the toner to which inorganic fine particles including at least one metal selected from the group consisting of Mg, Ca, Al, and Zn were externally added, the measurement is performed after the inorganic fine particles have been separated from the toner in order to prevent the calculation of the amount of the metal derived from the inorganic fine particles in addition to the metal forming the crosslinking with the polar portion.

(Method for Separating Materials from the Toner)

Materials can be separated from the toner by utilizing the difference in solubility of the respective materials contained in the toner in a solvent.

First separation: the toner is dissolved in methyl ethyl ketone (MEK) at 23° C., and the soluble matter (amorphous resin other than the polymer A) and the insoluble matter (polymer A, release agent, colorant, inorganic fine particles, and the like) are separated.

Second separation: the insoluble matter (polymer A, release agent, colorant, inorganic fine particles, and the like) obtained in the first separation is dissolved in MEK at 100° C., and the soluble matter (polymer A, release agent) and the insoluble matter (colorant, inorganic fine particles, and the like) are separated.

Third separation: the soluble matter (polymer A, release agent) obtained in the second separation is dissolved in chloroform at 23° C., and the soluble matter (polymer A) and the insoluble matter (release agent) are separated.

<Method for Measuring Metal Domain Diameter in Toner Particle Cross Section, and Method for Measuring Concentration Distribution of Polyvalent Metal in Toner Particle Cross Section>

The metal domain diameter in the toner particle cross section and the concentration distribution of the polyvalent metal in the toner particle cross section are measured by using a scanning electron microscope S-4800 (manufactured by Hitachi High-Tech Science Co., Ltd.) and an energy dispersive X-ray analyzer EDAX 204B to perform metal mapping measurements. The toner particle cross section to be observed is selected in the following manner. First, the cross-sectional area of the toner particle is determined from the toner particle cross-sectional image, and the diameter (circle-equivalent diameter) of a circle having an area equal to the cross-sectional area is determined. The observation is performed only with respect to the toner particle cross-sectional images in which the absolute value of the difference between the circle-equivalent diameter and the weight average particle diameter (D4) of the toner is within 1.0 μm.

Acceleration voltage: 20 kV

Magnification: 10,000 times

The distance between two points which are the farthest from each other in the portion where the mapping dots are continuous is measured and taken as the domain diameter. Also, the concentration distribution of the polyvalent metal can be determined by calculating the metal concentration with respect to the resin component in the region from the surface of the toner particle to the depth of 0.4 μm and the metal concentration with respect to the resin component in the region deeper than 0.4 μm from the surface of the toner particle in the toner particle depth direction from the toner particle surface to the toner particle center. The metal concentration in the region from the surface of the toner particle to the depth of 0.4 μm and in the region deeper than 0.4 μm from the surface of the toner particle was calculated from 100 toner particles, and the average value for 100 toner particles was taken as the respective metal concentration.

As a specific method, the captured image was binarized and calculations were performed using image processing software Image-Pro Plus 5.1 J (manufactured by Media Cybernetics, Inc.).

First, a portion of the toner particle group was extracted, and the size of one extracted toner particle was counted. Specifically, first, the toner particle group and the background portion were separated in order to extract a toner particle group to be analyzed. Then, "MEASUREMENT"–"COUNT/SIZE" in Image-Pro Plus 5.1J was selected. In the "BRIGHTNESS RANGE SELECTION" of "COUNT/SIZE", the brightness range was set to the range of 50 to 255, a carbon tape portion with a low brightness reflected as a background was excluded, and extraction of a toner particle group was performed. When extraction was performed, 4 connections were selected in the "COUNT/SIZE" extraction option, the smoothness was set to 5, and "FILL IN HOLES" was checked. With this operation, toner particles located on all boundaries (outer periphery) of the image and toner particles overlapping with other toner particles were excluded from the calculation. Next, "AREA AND FERET'S DIAMETER (AVERAGE)" was selected in the "COUNT/SIZE" measurement item, and toner particles to be subjected to image analysis were extracted with the area selection range being a minimum of 100 pixels and a maximum of 10,000 pixels. One toner particle was selected from the extracted toner particle group, and the size (number of pixels) js of the portion derived from the region from the surface of the toner particle to the depth of 0.4 μm was determined. The size (number of pixels) ji of the portion derived from the region deeper than 0.4 μm from the surface was determined in a similar manner.

Next, the sizes (number of pixels) ms and mi of the portion where the mapping dots are continuous in each region were determined. ms and mi are the total area of the scattered mapping dots. The metal concentration $s_1$ in the region from the surface of the toner particle to the depth of 0.4 μm was obtained from the obtained js and ms by using the following equation.

$$s_1=(ms/js)\times 100$$

A metal concentration $s_2$ in the region deeper than 0.4 μm from the surface of the toner particle was obtained in a similar manner.

$$s_2=(mi/ji)\times 100$$

Subsequently, the same processing was performed on each toner particle of the extracted toner particle group until the number of selected toner particles reached 100. When the number of toner particles in one field of view was less than 100, the same operation was repeated for the toner particle projection image in another field of view.

<Method for Measuring Content of Monomer Units Derived from Various Polymerizable Monomers in Polymer A>

The measurement of the content of monomer units derived from various polymerizable monomers in the polymer A is performed by $^1$H-NMR under the following conditions.

Measurement apparatus: FT NMR apparatus JNM-EX400 (manufactured by Nippon Denshi Co., Ltd.)

Measurement frequency: 400 MHz

Pulse condition: 5.0 μs

Frequency range: 10500 Hz

Accumulated number of times: 64 times

Measurement temperature: 30° C.

Sample: the sample is prepared by placing 50 mg of a measurement sample in a sample tube with an inner diameter of 5 mm, adding deuterated chloroform ($CDCl_3$) as a solvent, and dissolving in a thermostat at 40° C.

From the peaks attributed to the constituent components of the monomer unit derived from the first polymerizable monomer, a peak independent from the peaks attributed to the constituent component of the monomer units derived from other sources is selected from the obtained $^1$H-NMR chart, and the integral value $S_1$ of this peak is calculated.

Likewise, from the peaks attributed to the constituent components of the monomer unit derived from the second polymerizable monomer, a peak independent from the peaks attributed to the constituent component of the monomer units derived from other sources is selected, and the integral value $S_2$ of this peak is calculated.

Furthermore, when the third polymerizable monomer is used, from the peaks attributed to the constituent components of the monomer unit derived from the third polymerizable monomer, a peak independent from the peaks attributed to the constituent component of the monomer units derived from other sources is selected, and the integral value $S_3$ of this peak is calculated.

The content of the monomer unit derived from the first polymerizable monomer is determined as follows using the integrated values $S_1$, $S_2$ and $S_3$. Here, $n_1$, $n_2$ and $n_3$ are the number of hydrogen atoms in the constituent component to which the peak of interest in each segment is attributed.

Content of monomer units derived from the first polymerizable monomer (mol %)$=\{(S_1/n_1)/((S_1/n_1)+(S_2/n_2)+(S_3/n_3))\}\times 100$.

Similarly, the content of monomer units derived from the second polymerizable monomer and the third polymerizable monomer is determined as follows.

Content of monomer units derived from the second polymerizable monomer (mol %)$=\{(S_2/n_2)/((S_1/n_1)+(S_2/n_2)+(S_3/n_3))\}\times 100$.

Content of monomer units derived from the third polymerizable monomer (mol %)=$\{(S_3/n_3)/((S_1/n_1)+(S_2/n_2)+(S_3/n_3))\}\times 100$.

When a polymerizable monomer which does not include a hydrogen atom in a constituent component other than a vinyl group is used in the polymer A, the measurement atom nucleus is set to $^{13}C$ by using $^{13}C$-NMR, the measurement is performed in a single pulse mode, and the calculation is performed in the same manner by $^{1}H$-NMR.

Further, when the toner is produced by a suspension polymerization method, peaks of the release agent and other resin may overlap and an independent peak may not be observed. As a result, the content of monomer units derived from various polymerizable monomers in the polymer A may not be calculated. In that case, a polymer A' can be produced by the same suspension polymerization without using a release agent or other resin, and the analysis can be performed by regarding the polymer A' as the polymer A.

<SP Value Calculation Method>

The SP value of the polymerizable monomers and the SP value of the units derived from the polymerizable monomers are determined as follows according to the calculation method proposed by Fedors.

For each polymerizable monomer or release agent, evaporation energy (66) (cal/mol) and molar volume ($\Delta vi$) ($cm^3$/mol) are determined for an atom or atomic group in the molecular structure from the table described in "Polym. Eng. Sci., 14 (2), 147-154 (1974)", and $(4.184\times\Sigma\Delta ei/\Sigma\Delta vi)^{0.5}$ is taken as the SP value $(J/cm^3)^{0.5}$.

In addition, $SP_{11}$ and $SP_{21}$ are calculated by the same calculation method as described above with respect to atoms or atomic groups of the molecular structure in a state in which the double bond of the polymerizable monomer is cleaved by polymerization.

The $SP_{13}$ is calculated by the following formula by determining the evaporation energy ($\Delta ei$) and the molar volume ($\Delta vi$) of the monomer units derived from the polymerizable monomers constituting the polymer A for each monomer unit, calculating products with the molar ratio (j) of each monomer unit in the polymer A, and dividing the sum of the evaporation energies of the monomer units by the sum of molar volumes.

$$SP_3=\{4.184\times(\Sigma j\times\Sigma\Delta ei)/(\Sigma j\times\Sigma\Delta vi)\}^{0.5}$$

<Measurement of Peak Molecular Weight and Weight Average Molecular Weight of Polymer A and Resin Other than Polymer A by GPC>

The molecular weight (Mw) of the THF soluble matter of the polymer A and the resin other than the polymer A is measured by gel permeation chromatography (GPC) in the following manner.

First, the toner is dissolved in tetrahydrofuran (THF) at room temperature for 24 h. Then, the obtained solution is filtered through a solvent-resistant membrane filter "Maishori Disk" (manufactured by Tosoh Corporation) having a pore diameter of 0.2 μm to obtain a sample solution. The sample solution is adjusted so that the concentration of the component soluble in THF is about 0.8% by mass. The measurements are conducted under the following conditions by using this sample solution.

Device: HLC8120 GPC (detector: RI) (manufactured by Tosoh Corporation)

Column: seven columns of Shodex KF-801, 802, 803, 804, 805, 806, 807 (manufactured by Showa Denko K.K.)

Eluent: Tetrahydrofuran (THF)

Flow rate: 1.0 mL/min

Oven temperature: 40.0° C.

Sample injection volume: 0.10 mL

The molecular weight of the sample is calculated using a molecular weight calibration curve prepared using standard polystyrene resins (for example, trade names "TSK standard polystyrene F-850, F-450, F-288, F-128, F-80, F-40, F-20, F-10, F-4, F-2, F-1, A-5000, A-2500, A-1000, A-500, manufactured by Tosoh Corporation).

<Method for Measuring Softening Point of Amorphous Resin Other than Polymer A>

The softening point of amorphous resin other than polymer A is measured by using a capillary rheometer of a constant load extrusion type "Flow Characteristic Evaluation Device FLOW TESTER CFT-500D" (manufactured by Shimadzu Corporation) according to the manual provided with the device. With the device, the measurement sample filled in the cylinder is heated and melted while a constant load is applied from the top of the measurement sample by a piston, the melted measurement sample is extruded from the die at the bottom of the cylinder, and a flow curve showing the relationship between the piston descent amount at this time and temperature can be obtained.

In the present invention, the "melting temperature in the ½ method" described in the manual provided with the "Flow Characteristic Evaluation Device FLOW TESTER CFT-500D" is taken as the softening point.

The melting temperature in the ½ method is calculated as follows.

First, a half (½) of the difference between the piston descent amount at the end of the outflow (the end point of the outflow, Smax) and the piston descent amount at the start of the outflow (the minimum point, Smin) is determined (this is denoted by X. X=(Smax−Smin)/2). The temperature at the flow curve when the piston descent amount is the sum of X and Smin is the melting temperature in the ½ method.

About 1.0 g of the resin is compression molded at about 10 MPa for about 60 sec by using a tablet press (for example, NT-100H, manufactured by NPa SYSTEM CO., LTD.) under an environment of 25° C. to obtain a cylindrical sample having a diameter of about 8 mm that is used for measurement.

The specific operations in the measurement are performed according to the manual provided with the device.

The measurement conditions of CFT-500D are as follows.

Test mode: temperature rising method

Starting temperature: 50° C.

Reached temperature: 200° C.

Measurement interval: 1.0° C.

Ramp rate: 4.0° C./min

Piston cross-sectional area: 1.000 $cm^2$

Test load (piston load): 10.0 kgf (0.9807 MPa)

Preheating time: 300 sec

Die hole diameter: 1.0 mm

Die length: 1.0 mm

<Measurement of Glass Transition Temperature (Tg) of Amorphous Resin Other than Polymer A>

The glass transition temperature (Tg) is measured according to ASTM D3418-82 by using a differential scanning calorimeter "Q2000" (manufactured by TA Instruments).

The melting points of indium and zinc are used for temperature correction of the device detection unit, and the melting heat of indium is used for correction of heat quantity.

Specifically, measurements are performed under the following conditions by accurately weighing 3 mg of a sample, placing the sample in an aluminum pan, and using an empty aluminum pan as a reference.

Ramp rate: 10° C./min

Measurement start temperature: 30° C.

Measurement end temperature: 180° C.

In the measurement, the temperature is raised to 180° C. and held for 10 min, and then the temperature is lowered to 30° C. at a temperature lowering rate of 10° C./min, and thereafter the temperature is raised again. In the second temperature raising process, a change in specific heat is obtained in the temperature range of 30° C. to 100° C. The intersection point of the line at the midpoint between the baselines before and after the specific heat change at this time and the differential thermal curve is taken as a glass transition temperature (Tg).

Further, the temperature at the maximum endothermic peak of the temperature–heat absorption amount curve in the temperature range of 60° C. to 90° C. is taken as the melting peak temperature (Tp) of the melting point of the polymer.

(Separation of Polymer A and Binder Resin from Toner)

Similar to the above method, after the polymer A and the binder resin are separated from the toner by utilizing the difference in solubility in the solvent, DSC measurement is performed.

<Method for Measuring Acid Value (Av) of Polymer A and Amorphous Resin Other than Polymer A>

The acid value is the number of milligrams of potassium hydroxide required to neutralize the acid component such as a free fatty acid, a resin acid and the like contained in 1 g of the sample. The acid value is measured according to JIS K 0070-1992.

(1) Reagent

A total of 1.0 g of phenolphthalein is dissolved in 90 mL of ethyl alcohol (95% by volume), and ion-exchanged water is added to make it 100 mL and obtain a phenolphthalein solution.

A total of 7 g of special grade potassium hydroxide is dissolved in 5 mL of water, and ethyl alcohol (95% by volume) is added to make 1 L. The solution is placed in an alkali-resistant container and allowed to stand for 3 days, while preventing contact with carbon dioxide gas and the like, and filtration is thereafter performed to obtain a potassium hydroxide solution. The obtained potassium hydroxide solution is stored in an alkali resistant container. A total of 25 mL of 0.1 mol/L hydrochloric acid is placed in an Erlenmeyer flask, several drops of the phenolphthalein solution are added thereto, titration is performed with the potassium hydroxide solution, and the factor of the potassium hydroxide solution is determine from the amount of the potassium hydroxide solution required for neutralization. The 0.1 mol/L hydrochloric acid prepared according to JIS K 8001-1998 is used.

(2) Operation (A) Main Test

A total of 2.0 g of the ground sample is accurately weighed into a 200 mL Erlenmeyer flask, 100 mL of a mixed solution of toluene/ethanol (2:1) is added, and dissolution is performed for 5 h. Subsequently, several drops of the phenolphthalein solution are added as an indicator, and titration is performed using the potassium hydroxide solution. The end point of titration is assumed to be when the pale pink color of the indicator lasts for about 30 sec.

(B) Blank Test

Titration is performed in the same manner as described hereinabove except that no sample is used (that is, only a mixed solution of toluene/ethanol (2:1) is used).

(3) The obtained result is substituted into the following formula to calculate the acid value.

$$A=[(C-B)\times f\times 5.61]/S$$

Here, A: acid value (mg KOH/g), B: addition amount (mL) of the potassium hydroxide solution in the blank test, C: addition amount (mL) of the potassium hydroxide solution in the main test, f: factor of potassium hydroxide solution, S: mass of the sample (g).

<Method for Measuring Weight Average Particle Diameter (D4) of Toner>

The weight average particle diameter (D4) of the toner is calculated in the following manner. A precision particle size distribution measuring apparatus (registered trademark, "Coulter Counter Multisizer 3", manufactured by Beckman Coulter, Inc.) based on a pore electric resistance method and equipped with an aperture tube having a diameter of 100 μm is used as a measurement apparatus. The dedicated software "Beckman Coulter Multisizer 3 Version 3.51" (manufactured by Beckman Coulter, Inc.), which is provided with the apparatus, is used to set the measurement conditions and analyze the measurement data. The measurement is performed with 25,000 effective measurement channels A solution prepared by dissolving special grade sodium chloride in ion exchanged water to a concentration of about 1% by mass, for example, "ISOTON II" manufactured by Beckman Coulter, Inc., can be used as the electrolytic aqueous solution to be used for measurements.

The dedicated software is set up in the following manner before the measurement and analysis.

The total count number in a control mode is set to 50,000 particles on a "CHANGE STANDARD OBSERVATION METHOD (SOM)" screen of the dedicated software, the number of measurements is set to 1, and a value obtained using "standard particles 10.0 μm" (manufactured by Beckman Coulter, Inc.) is set as a Kd value. The threshold and the noise level are automatically set by pressing a "THRESHOLD/NOISE LEVEL MEASUREMENT" button. Further, the current is set to 1600 μA, the gain is set to 2, the electrolytic solution is set to ISOTON II, and "FLUSH OF APERTURE TUBE AFTER MEASUREMENT" is checked.

In the "PULSE TO PARTICLE DIAMETER CONVERSION SETTING" screen of the dedicated software, the bin interval is set to a logarithmic particle diameter, the particle diameter bin is set to a 256-particle diameter bin, and a particle diameter range is set from 2 μm to 60 μm.

A specific measurement method is described hereinbelow.

(1) Approximately 200 mL of the electrolytic aqueous solution is placed in a glass 250 mL round-bottom beaker dedicated to Multisizer 3, the beaker is set in a sample stand, and stirring with a stirrer rod is carried out counterclockwise at 24 rpm. Dirt and air bubbles in the aperture tube are removed by the "FLUSH OF APERTURE" function of the dedicated software.

(2) A total of about 30 mL of the electrolytic aqueous solution is placed in a glass 100 mL flat-bottom beaker. Then, about 0.3 mL of a diluted solution obtained by 3-fold mass dilution of "CONTAMINON N" (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) with ion exchanged water is added as a dispersing agent thereto.

(3) An ultrasonic disperser "Ultrasonic Dispersion System Tetora 150" (manufactured by Nikkaki Bios Co., Ltd.) with an electrical output of 120 W in which two oscillators with an oscillation frequency of 50 kHz are built in with a phase shift of 180 degrees is prepared. A total of 3.3 L of ion exchanged water is placed in the water tank of the ultrasonic disperser, and about 2 mL of CONTAMINON N is added to the water tank.

(4) The beaker of (2) hereinabove is set in the beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(5) A total of 10 mg of the toner particles are added little by little to the electrolytic aqueous solution and dispersed therein in a state in which the electrolytic aqueous solution in the beaker of (4) hereinabove is irradiated with ultrasonic waves. Then, the ultrasonic dispersion process is further continued for 60 sec. In the ultrasonic dispersion, the water temperature in the water tank is appropriately adjusted to a temperature from 10° C. to 40° C.

(6) The electrolytic aqueous solution of (5) hereinabove in which the toner particles are dispersed is dropped using a pipette into the round bottom beaker of (1) hereinabove which has been set in the sample stand, and the measurement concentration is adjusted to be about 5%. Then, measurement is conducted until the number of particles to be measured reaches 50,000.

(7) The measurement data are analyzed with the dedicated software provided with the apparatus, and the weight average particle diameter (D4) is calculated. The "AVERAGE DIAMETER" on the "ANALYSIS/VOLUME STATISTICAL VALUE (ARITHMETIC MEAN)" screen when the special software is set to graph/volume % is the weight average particle diameter (D4).

<Method for Measuring Average Circularity of Toner>

The average circularity of the toner is measured by a flow type particle image analyzer "FPIA-3000" (manufactured by Sysmex Corporation) under the measurement and analysis conditions at the time of calibration.

The measurement principle of the flow type particle image analyzer "FPIA-3000" (manufactured by Sysmex Corporation) is to capture an image of flowing particles as a still image and perform image analysis. The sample added to a sample chamber is fed to a flat sheath flow cell by a sample suction syringe. The sample fed into the flat sheath flow is sandwiched by the sheath liquid to form a flat flow. The sample passing through the flat sheath flow cell is irradiated with strobe light at intervals of 1/60 sec, and the image of flowing particles can be captured as a still image. Further, since the flow is flat, the image is captured in focus. The particle image is captured by a CCD camera, and the captured image is subjected to image processing with an image processing resolution of 512×512 pixels (0.37×0.37 μm per pixel), the outline of each particle image is extracted, and a projected area S, a perimeter L and the like of the particle image are measured.

Next, a circle-equivalent diameter and a circularity are determined using the area S and the perimeter L. The circle-equivalent diameter is the diameter of a circle having the same area as the projected area of the particle image, and the circularity C is determined as a value obtained by dividing the perimeter of the circle determined from the circle-equivalent diameter by the perimeter of the particle projection image. The circularity is calculated by the following formula.

$$\text{Circularity } C = 2\times(\pi\times S)^{1/2}/L$$

When the particle image is circular, the circularity is 1.000, and the circularity assumes a smaller value as the degree of unevenness on the periphery of the particle image increases. After calculating the circularity of each particle, the range of circularity of from 0.200 to 1.000 is divided into 800, the arithmetic mean value of the circularities obtained is calculated, and this value is defined as the average circularity.

The specific measurement method is described hereinbelow.

First, about 20 mL of ion exchanged water from which solid impurities and the like have been removed in advance is placed in a glass container. About 0.2 mL of a diluent prepared by diluting "CONTAMINON N" (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) with about three-fold mass of ion exchanged water is added as a dispersing agent thereto.

Further, about 0.02 g of a measurement sample is added, and dispersion treatment is performed for 2 min using an ultrasonic wave disperser to obtain a dispersion for measurement. At that time, the dispersion solution is suitably cooled to a temperature of 10° C. to 40° C. As the ultrasonic wave disperser, a table-top type ultrasonic cleaner disperser ("VS-150" (manufactured by VELVO-CLEAR Co.)) having an oscillation frequency of 50 kHz and an electric output of 150 W is used, a predetermined amount of ion exchanged water is placed into a water tank, and about 2 mL of the CONTAMINON N is added to the water tank.

For measurement, the flow type particle image analyzer equipped with a standard objective lens (×10) is used, and a particle sheath "PSE-900A" (manufactured by Sysmex Corporation) is used as a sheath liquid. The dispersion solution prepared according to the procedure is introduced into the flow type particle image analyzer, and 3,000 toner particles are measured in a total count mode in an HPF measurement mode.

Then, the binarization threshold value at the time of particle analysis is set to 85%, the particle diameter to be analyzed is set to a circle-equivalent diameter of 1.98 μm to 39.96 μm, and the average circularity of the toner is obtained.

In the measurement, automatic focusing is performed using standard latex particles (for example, "RESEARCH AND TEST PARTICLES Latex Microsphere Suspensions 5200A" manufactured by Duke Scientific Inc. which are diluted with ion exchanged water) before the start of the measurement. After that, it is preferable to perform focusing every 2 h from the start of the measurement.

<Method for Measuring 50% Particle Size (D50), Based on Volume Distribution, of Polymer Fine Particles, Amorphous Resin Fine Particles Other than Polymer A, Aliphatic Hydrocarbon Compound Fine Particles, and Colorant Fine Particles>

A dynamic light scattering type particle size distribution meter NANOTRAC UPA-EX150 (manufactured by Nikkiso Co., Ltd.) is used for measuring the 50% particle size (D50), based on volume distribution, of polymer fine particles, amorphous resin fine particles other than the polymer A, aliphatic hydrocarbon compound fine particles, and colorant fine particles. Specifically, the measurement is performed according to the following procedure.

In order to prevent aggregation of the measurement sample, the dispersion solution in which the measurement sample is dispersed is introduced into an aqueous solution including FAMILY FRESH (manufactured by Kao Corporation) and stirred. After stirring, the measurement sample is injected into the abovementioned device, the measurement is performed twice, and the average value is determined.

As the measurement conditions, the measurement time is 30 sec, the sample particle refractive index is 1.49, the dispersion medium is water, and the dispersion medium refractive index is 1.33.

The volume particle size distribution of the measurement sample is measured, and the particle diameter at which the cumulative volume from the small particle diameter side in the cumulative volume distribution from the measurement results is 50% is taken as the 50% particle diameter (D50), based on the volume distribution, of each particle. <Method for Measuring Complex Viscosity of Toner>

A rotating plate type rheometer "ARES" (manufactured by TA INSTRUMENTS) is used as a measurement device.

A sample obtained by pressure-molding the toner in a disk shape having a diameter of 25 mm and a thickness of 2.0±0.3 mm by using a tablet molding machine under an environment of 25° C. is used as a measurement sample.

The sample is mounted on a parallel plate, and the temperature is raised from room temperature (25° C.) to 110° C. over 15 min to adjust the shape of the sample, followed by cooling to the measurement start temperature of the viscoelasticity. The measurement is then started and a complex viscosity is measured. At this time, the measurement sample is set so that the initial normal force becomes zero. Also, in the subsequent measurement, it is possible to cancel the influence of the normal force by performing the automatic tension adjustment (Auto Tension Adjustment ON) as described below.

The measurement is performed under the following conditions.

(1) A parallel plate having a diameter of 25 mm is used.

(2) The frequency is set to 6.28 rad/sec (1.0 Hz).

(3) The applied strain initial value (Strain) is set to 1.0%.

(4) The measurement is performed at a Ramp Rate of 2.0° C./min between 40° C. and 100° C. In the measurement, the following setting conditions of the automatic adjustment mode are used. The measurement is performed in the automatic strain adjustment mode (Auto Strain).

(5) The Max Applied Strain is set to 40.0%.

(6) The Max Allowed Torque is set to 150.0 g·cm, and the Min Allowed Torque is set to 0.2 g·cm.

(7) The Strain Adjustment is set to 20.0% of Current Strain. In the measurement, the automatic tension adjustment mode (Auto Tension) is used.

(8) The Auto Tension Direction is set as Compression.

(9) The Initial Static Force is set to 10.0 g, and the Auto Tension Sensitivity is set to 40.0 g.

(10) As the operation condition of the Auto Tension, a Sample Modulus is $1.0\times10^3$ Pa or more.

EXAMPLES

Hereinafter, the present invention will be specifically described by way of examples, but these do not limit the present invention at all. In the following formulations, parts are by mass unless otherwise specified.

Production Example of Polymer A1

| | |
|---|---|
| Solvent: toluene | 100.0 parts |
| Monomer composition (the monomer composition is assumed to be obtained by mixing the following behenyl acrylate, methacrylonitrile, and styrene in the ratios shown below) | 100.0 parts |
| Behenyl acrylate (first polymerizable monomer) | 67.0 parts (28.9 mol %) |
| Methacrylonitrile (second polymerizable monomer) | 22.0 parts (53.8 mol %) |
| Styrene (third polymerizable monomer) | 11.0 parts (17.3 mol %) |
| Polymerization initiator: t-butylperoxypivalate (manufactured by NOF Corporation: PERBUTYL PV) | 0.5 parts |

The above materials were charged under a nitrogen atmosphere into a reaction vessel equipped with a reflux condenser, a stirrer, a thermometer, and a nitrogen introduction pipe. The materials were heated in the reaction vessel to 70° C. and a polymerization reaction was carried out for 12 h under stirring at 200 rpm to obtain a solution in which the polymer of the monomer composition was dissolved in toluene. Subsequently, the temperature of the solution was lowered to 25° C., and then the solution was charged into 1000.0 parts of methanol under stirring to precipitate methanol insolubles. The obtained methanol insolubles were separated by filtration, further washed with methanol and vacuum dried at 40° C. for 24 h to obtain a polymer A1. The weight average molecular weight of the polymer A1 was 68,400, the melting point was 62° C., and the acid value was 0.0 mg KOH/g.

The polymer A1 was analyzed by NMR and found to include 28.9 mol % of a monomer unit derived from behenyl acrylate, 53.8 mol % of a monomer unit derived from methacrylonitrile, and 17.3 mol % of a monomer unit derived from styrene. The SP values of the polymerizable monomers and the units derived from the polymerizable monomers were calculated by the above method.

<Preparation of Monomer Having Urethane Group>

A total of 50.0 parts of methanol was charged to the reaction vessel. Then, 5.0 parts of KARENZ MOI [2-isocyanatoethyl methacrylate] (Showa Denko KK) was dropwise added at 40° C. under stirring. After completion of the dropwise addition, stirring was performed for 2 h while maintaining 40° C. Then, the monomer which had a urethane group was prepared by removing unreacted methanol with an evaporator.

<Preparation of Monomer Having Urea Group>

A total of 50.0 parts of dibutylamine was charged to a reaction vessel. Then, 5.0 parts of KARENZ MOI [2-isocyanatoethyl methacrylate] (Showa Denko KK) was dropwise added at room temperature under stirring. After completion of the dropwise addition, stirring was performed for 2 h. Then, the monomer which had a urea group was prepared by removing unreacted dibutylamine with an evaporator.

Production Examples of Polymers A2 to A30

Polymers A2 to A30 were obtained by conducting the reaction in the same manner as in the production example of polymer A1, except that the polymerizable monomers and the number of parts were changed as shown in Table 1. Physical properties of the polymers A1 to A30 are shown in Tables 2 to 4.

TABLE 1

| Polymer | First polymerizable monomer | | | Second polymerizable monomer | | | Third polymerizable monomer | | |
|---|---|---|---|---|---|---|---|---|---|
| A | Type | Parts | mol % | Type | Parts | mol % | Type | Parts | mol % |
| 1 | BEA | 67.0 | 28.9 | MN | 22.0 | 53.8 | St | 11.0 | 17.3 |
| 2 | BEA | 67.0 | 25.3 | AN | 22.0 | 59.5 | St | 11.0 | 15.2 |
| 3 | BEA | 50.0 | 26.0 | HPMA | 40.0 | 55.0 | St | 10.0 | 19.0 |
| 4 | BEA | 65.0 | 27.6 | AM | 25.0 | 56.9 | St | 10.0 | 15.5 |
| 5 | BEA | 40.0 | 11.4 | AN | 27.5 | 56.0 | St | 30.0 | 31.2 |
| | | | | UT | 2.5 | 1.4 | | | |
| 6 | BEA | 40.0 | 11.4 | AN | 27.5 | 56.3 | St | 30.0 | 31.3 |
| | | | | UR | 2.5 | 1.0 | | | |
| 7 | BEA | 61.0 | 27.4 | AA | 9.0 | 21.4 | MM | 30.0 | 51.2 |
| 8 | BEA | 60.0 | 26.2 | VA | 30.0 | 57.9 | St | 10.0 | 15.9 |
| 9 | BEA | 60.0 | 26.2 | MA | 30.0 | 57.9 | St | 10.0 | 15.9 |
| 10 | BEA | 89.0 | 58.8 | MN | 11.0 | 41.2 | — | — | — |
| 11 | BEA | 40.0 | 10.5 | MN | 60.0 | 89.5 | — | — | — |
| 12 | BEA | 40.0 | 11.8 | MN | 40.0 | 66.7 | St | 20.0 | 21.5 |
| 13 | BEA | 61.0 | 27.5 | MN | 9.0 | 23.0 | St | 30.0 | 49.5 |
| 14 | BEA | 34.0 | 11.4 | MN | 11.0 | 21.0 | St | 55.0 | 67.6 |
| 15 | SA | 67.0 | 32.3 | MN | 22.0 | 51.2 | St | 11.0 | 16.5 |
| 16 | MYA | 67.0 | 23.9 | MN | 22.0 | 57.6 | St | 11.0 | 18.5 |
| 17 | OA | 67.0 | 25.0 | MN | 22.0 | 56.8 | St | 11.0 | 18.2 |
| 18 | BEA | 63.0 | 28.2 | MN | 7.0 | 17.7 | St | 23.0 | 37.6 |
| | | | | AA | 7.0 | 16.5 | | | |
| 19 | BEA | 63.0 | 26.3 | MN | 15.0 | 35.5 | St | 15.0 | 22.8 |
| | | | | AA | 7.0 | 15.4 | | | |
| 20 | BEA | 47.0 | 20.0 | MN | 22.0 | 53.0 | St | 11.0 | 17.0 |
| | SA | 20.0 | 10.0 | | | | | | |
| 21 | BEA | 33.0 | 14.3 | MN | 22.0 | 54.1 | St | 11.0 | 17.4 |
| | BMA | 34.0 | 14.2 | | | | | | |
| 22 | BEA | 66.6 | 33.2 | AA | 4.8 | 12.6 | MM | 28.6 | 54.2 |
| 23 | BEA | 90.0 | 61.3 | MN | 10.0 | 38.7 | — | — | — |
| 24 | BEA | 61.0 | 28.0 | MN | 7.0 | 18.2 | St | 32.0 | 53.8 |
| 25 | HA | 61.0 | 28.6 | MN | 26.0 | 54.0 | St | 13.0 | 17.4 |
| 26 | BEA | 60.0 | 28.5 | — | — | — | St | 11.0 | 19.1 |
| | | | | | | | MM | 29.0 | 52.4 |
| 27 | BEA | 25.0 | 7.0 | VA | 75.0 | 93.0 | — | — | — |
| 28 | BEA | 20.0 | 4.8 | MN | 53.0 | 71.7 | St | 27.0 | 23.5 |
| 29 | BEA | 20.0 | 4.2 | MN | 80.0 | 95.8 | — | — | — |
| 30 | BEA | 15.0 | 4.3 | MN | 10.0 | 16.4 | St | 75.0 | 79.3 |

The abbreviations in Tables 1 to 4 are as follows.
BEA: behenyl acrylate
BMA: behenyl methacrylate
SA: stearyl acrylate
MYA: myricyl acrylate
OA: octacosyl acrylate
HA: hexadecyl acrylate
MN: methacrylonitrile
AN: acrylonitrile
HPMA: 2-hydroxypropyl methacrylate
AM: acrylamide
UT: monomer having a urethane group
UR: monomer having a urea group
AA: acrylic acid
VA: vinyl acetate
MA: methyl acrylate
St: styrene
MM: methyl methacrylate

TABLE 2

| Polymer | First monomer unit | | Second monomer unit | | Third monomer unit | | Formula (4) |
|---|---|---|---|---|---|---|---|
| A | Monomer | $SP_{12}$ | Monomer | $SP_{22}$ | Monomer | $SP_{32}$ | $SP_{22} - SP_{12}$ |
| 1 | BEA | 17.69 | MN | 21.97 | St | 17.94 | 4.28 |
| 2 | BEA | 17.69 | AN | 22.75 | St | 17.94 | 5.05 |
| 3 | BEA | 17.69 | HPMA | 22.05 | St | 17.94 | 4.36 |
| 4 | BEA | 17.69 | AM | 29.13 | St | 17.94 | 11.43 |
| 5 | BEA | 17.69 | AN | 22.75 | St | 17.94 | 5.05 |
| | | | UT | 21.91 | | | 4.21 |

TABLE 2-continued

| Polymer | First monomer unit | | Second monomer unit | | Third monomer unit | | Formula (4) |
|---|---|---|---|---|---|---|---|
| A | Monomer | $SP_{12}$ | Monomer | $SP_{22}$ | Monomer | $SP_{32}$ | $SP_{22} - SP_{12}$ |
| 6 | BEA | 17.69 | AN | 22.75 | St | 17.94 | 5.05 |
| | | | UR | 20.86 | | | 3.17 |
| 7 | BEA | 17.69 | AA | 22.66 | MM | 18.27 | 4.97 |
| 8 | BEA | 17.69 | VA | 18.31 | St | 17.94 | 0.62 |
| 9 | BEA | 17.69 | MA | 18.31 | St | 17.94 | 0.62 |
| 10 | BEA | 17.69 | MN | 21.97 | — | — | 4.28 |
| 11 | BEA | 17.69 | MN | 21.97 | — | — | 4.28 |
| 12 | BEA | 17.69 | MN | 21.97 | St | 17.94 | 4.28 |
| 13 | BEA | 17.69 | MN | 21.97 | St | 17.94 | 4.28 |
| 14 | BEA | 17.69 | MN | 21.97 | St | 17.94 | 4.28 |
| 15 | SA | 17.71 | MN | 21.97 | St | 17.94 | 4.25 |
| 16 | MYA | 17.65 | MN | 21.97 | St | 17.94 | 4.32 |
| 17 | OA | 17.65 | MN | 21.97 | St | 17.94 | 4.32 |
| 18 | BEA | 17.69 | MN | 21.97 | St | 17.94 | 4.28 |
| | | | AA | 21.66 | | | 4.97 |
| 19 | BEA | 17.69 | MN | 21.97 | St | 17.94 | 4.28 |
| | | | AA | 21.66 | | | 4.97 |
| 20 | BEA | 17.69 | MN | 21.97 | St | 17.94 | 4.27 |
| | SA | 17.71 | | | | | |
| 21 | BEA | 17.69 | MN | 21.97 | St | 17.94 | 4.32 |
| | BMA | 17.61 | | | | | |
| 22 | BEA | 17.69 | AA | 22.66 | MM | 18.27 | 4.97 |
| 23 | BEA | 17.69 | MN | 21.97 | — | — | 4.28 |
| 24 | BEA | 17.69 | MN | 21.97 | St | 17.94 | 4.28 |
| 25 | HA | 17.73 | MN | 21.97 | St | 17.94 | 4.24 |
| 26 | BEA | 17.69 | — | — | St | 17.94 | — |
| | | | | | MM | 18.27 | — |
| 27 | BEA | 17.69 | VA | 18.31 | — | — | 0.62 |
| 28 | BEA | 17.69 | MN | 21.97 | St | 17.94 | 4.28 |
| 29 | BEA | 17.69 | MN | 21.97 | — | — | 4.28 |
| 30 | BEA | 17.69 | MN | 21.97 | St | 17.94 | 4.28 |

TABLE 3

| Polymer | First monomer unit | | Second monomer unit | | Third monomer unit | | Formula (1) |
|---|---|---|---|---|---|---|---|
| A | Unit | $SP_{11}$ | Unit | $SP_{21}$ | Unit | $SP_{31}$ | $SP_{21} - SP_{11}$ |
| 1 | BEA | 18.25 | MN | 25.96 | St | 20.11 | 7.71 |
| 2 | BEA | 18.25 | AN | 29.43 | St | 20.11 | 11.19 |
| 3 | BEA | 18.25 | HPMA | 24.12 | St | 20.11 | 5.87 |
| 4 | BEA | 18.25 | AM | 39.25 | St | 20.11 | 21.01 |
| 5 | BEA | 18.25 | AN | 29.43 | St | 20.11 | 11.19 |
| | | | UT | 23.79 | | | 5.54 |
| 6 | BEA | 18.25 | AN | 29.43 | St | 20.11 | 11.19 |
| | | | UR | 21.74 | | | 3.50 |
| 7 | BEA | 18.25 | AA | 28.72 | MM | 20.31 | 10.47 |
| 8 | BEA | 18.25 | VA | 21.60 | St | 20.11 | 3.35 |
| 9 | BEA | 18.25 | MA | 21.60 | St | 20.11 | 3.35 |
| 10 | BEA | 18.25 | MN | 25.96 | — | — | 7.71 |
| 11 | BEA | 18.25 | MN | 25.96 | — | — | 7.71 |
| 12 | BEA | 18.25 | MN | 25.96 | St | 20.11 | 7.71 |
| 13 | BEA | 18.25 | MN | 25.96 | St | 20.11 | 7.71 |
| 14 | BEA | 18.25 | MN | 25.96 | St | 20.11 | 7.71 |
| 15 | SA | 18.39 | MN | 25.96 | St | 20.11 | 7.57 |
| 16 | MYA | 18.08 | MN | 25.96 | St | 20.11 | 7.88 |
| 17 | OA | 18.10 | MN | 25.96 | St | 20.11 | 7.85 |
| 18 | BEA | 18.25 | MN | 25.96 | St | 20.11 | 7.71 |
| | | | AA | 28.72 | | | 10.47 |
| 19 | BEA | 18.25 | MN | 25.96 | St | 20.11 | 7.71 |
| | | | AA | 28.72 | | | 10.47 |
| 20 | BEA | 18.25 | MN | 25.96 | St | 20.11 | 7.67 |
| | SA | 18.39 | | | | | |
| 21 | BEA | 18.25 | MN | 25.96 | St | 20.11 | 7.79 |
| | BMA | 18.10 | | | | | |
| 22 | BEA | 18.25 | AA | 28.72 | MM | 20.31 | 10.47 |
| 23 | BEA | 18.25 | MN | 25.96 | — | — | 7.71 |
| 24 | BEA | 18.25 | MN | 25.96 | St | 20.11 | 7.71 |
| 25 | HA | 18.47 | MN | 25.96 | St | 20.11 | 7.49 |

TABLE 3-continued

| Polymer | First monomer unit | | Second monomer unit | | Third monomer unit | | Formula (1) |
|---|---|---|---|---|---|---|---|
| A | Unit | $SP_{11}$ | Unit | $SP_{21}$ | Unit | $SP_{31}$ | $SP_{21} - SP_{11}$ |
| 26 | BEA | 18.25 | — | — | St | 20.11 | — |
| | | | | | MM | 20.31 | — |
| 27 | BEA | 18.25 | VA | 21.60 | — | — | 3.35 |
| 28 | BEA | 18.25 | MN | 25.96 | St | 20.11 | 7.71 |
| 29 | BEA | 18.25 | MN | 25.96 | — | — | 7.71 |
| 30 | BEA | 18.25 | MN | 25.96 | St | 20.11 | 7.71 |

TABLE 4

| Polymer A | Mw | Tp [° C.] | Av [mg KOH/g] |
|---|---|---|---|
| 1 | 68400 | 62 | 0.0 |
| 2 | 67100 | 62 | 0.0 |
| 3 | 67500 | 59 | 0.0 |
| 4 | 63900 | 59 | 0.0 |
| 5 | 63900 | 55 | 0.0 |
| 6 | 68100 | 55 | 0.0 |
| 7 | 62800 | 57 | 70.0 |
| 8 | 64600 | 56 | 0.0 |
| 9 | 66400 | 54 | 0.0 |
| 10 | 65800 | 62 | 0.0 |
| 11 | 66500 | 56 | 0.0 |
| 12 | 62800 | 55 | 0.0 |
| 13 | 64600 | 57 | 0.0 |
| 14 | 64500 | 53 | 0.0 |
| 15 | 66400 | 54 | 0.0 |
| 16 | 62900 | 76 | 0.0 |
| 17 | 64500 | 78 | 0.0 |
| 18 | 67800 | 58 | 54.4 |

TABLE 4-continued

| Polymer A | Mw | Tp [° C.] | Av [mg KOH/g] |
|---|---|---|---|
| 19 | 64700 | 61 | 54.5 |
| 20 | 66100 | 58 | 0.0 |
| 21 | 68900 | 62 | 0.0 |
| 22 | 63500 | 56 | 37.3 |
| 23 | 67100 | 62 | 0.0 |
| 24 | 61900 | 56 | 0.0 |
| 25 | 66600 | 45 | 0.0 |
| 26 | 63800 | 52 | 0.0 |
| 27 | 64600 | 59 | 0.0 |
| 28 | 65600 | 55 | 0.0 |
| 29 | 64400 | 55 | 0.0 |
| 30 | 63500 | 51 | 0.0 |

Production Example of Amorphous Resin 1 Other than Polymer A

| | |
|---|---|
| Solvent: xylene | 100.0 parts |
| Styrene | 95.0 parts |
| n-Butyl acrylate | 5.0 parts |
| Polymerization initiator t-butylperoxypivalate (manufactured by NOF Corporation: PERBUTYL PV) | 0.5 parts |

The above materials were charged under a nitrogen atmosphere into a reaction vessel equipped with a reflux condenser, a stirrer, a thermometer, and a nitrogen introduction pipe. The materials were heated in the reaction vessel to 185° C. and a polymerization reaction was carried out for 10 h under stirring at 200 rpm. Subsequently, the solvent was removed, and vacuum drying was performed at 40° C. for 24 h to obtain an amorphous resin 1 other than the polymer A. The weight average molecular weight of the amorphous resin 1 other than the polymer A was 3500, the softening point was 96° C., the glass transition temperature Tg was 58° C., and the acid value was 0.0 mg KOH/g.

Production Example of Dispersed Solution of Polymer Fine Particles 1

| | |
|---|---|
| Toluene (Wako Pure Chemical Industries) | 300 parts |
| Polymer A1 | 100 parts |

The above materials were weighed, mixed, and dissolved at 90° C.

Separately, 5.0 parts of sodium dodecylbenzene sulfonate and 10.0 parts of sodium laurate were added to 700 parts of ion exchanged water, and the components was heated and dissolved at 90° C.

Then, the toluene solution and the aqueous solution were mixed and stirred at 7000 rpm by using an ultrahigh-speed stirring device T. K. ROBOMIX (manufactured by PRIMIX Corporation). The mixture was then emulsified at a pressure of 200 MPa by using a high-pressure impact type dispersing machine NANOMIZER (manufactured by Yoshida Kikai Co., Ltd.). Thereafter, toluene was removed using an evaporator, and the concentration was adjusted with ion exchanged water to obtain an aqueous dispersion solution (dispersion solution of polymer fine particles 1) in which the concentration of the polymer fine particles 1 was 20% by mass.

The 50% particle size (D50), based on volume distribution, of the polymer fine particles 1 was measured using a dynamic light scattering type particle size distribution meter NANOTRAC UPA-EX150 (manufactured by Nikkiso Co., Ltd.), and the result was 0.40 μm.

Production Example of Dispersion Solutions of Polymer Fine Particles 2 to 30

Emulsification was carried out to obtain dispersion solutions of polymer fine particles 2 to 30 in the same manner as in the production example of the dispersion solution of polymer fine particles 1, except that the polymer A was changed as shown in Table 5. Physical properties of the dispersion solutions of polymer fine particles 1 to 30 are shown in Table 5.

TABLE 5

| Polymer fine particle-dispersed solution | Toluene solution | | | Aqueous solution | | Physical property D50 |
|---|---|---|---|---|---|---|
| | Toluene | Polymer A | | Sodium dodecylbenzene sulfonate | Sodium laurate | |
| | Parts | Type | Parts | Parts | Parts | [μm] |
| 1 | 300 | 1 | 100 | 5 | 10 | 0.4 |
| 2 | 300 | 2 | 100 | 5 | 10 | 0.4 |
| 3 | 300 | 3 | 100 | 5 | 10 | 0.4 |
| 4 | 300 | 4 | 100 | 5 | 10 | 0.4 |
| 5 | 300 | 5 | 100 | 5 | 10 | 0.4 |
| 6 | 300 | 6 | 100 | 5 | 10 | 0.4 |
| 7 | 300 | 7 | 100 | 5 | 10 | 0.4 |
| 8 | 300 | 8 | 100 | 5 | 10 | 0.4 |
| 9 | 300 | 9 | 100 | 5 | 10 | 0.4 |
| 10 | 300 | 10 | 100 | 5 | 10 | 0.4 |
| 11 | 300 | 11 | 100 | 5 | 10 | 0.4 |
| 12 | 300 | 12 | 100 | 5 | 10 | 0.4 |
| 13 | 300 | 13 | 100 | 5 | 10 | 0.4 |
| 14 | 300 | 14 | 100 | 5 | 10 | 0.4 |
| 15 | 300 | 15 | 100 | 5 | 10 | 0.4 |
| 16 | 300 | 16 | 100 | 5 | 10 | 0.4 |
| 17 | 300 | 17 | 100 | 5 | 10 | 0.4 |
| 18 | 300 | 18 | 100 | 5 | 10 | 0.4 |
| 19 | 300 | 19 | 100 | 5 | 10 | 0.4 |

TABLE 5-continued

| Polymer fine particle-dispersed solution | Toluene solution: Toluene Parts | Toluene solution: Polymer A Type | Toluene solution: Polymer A Parts | Aqueous solution: Sodium dodecylbenzene sulfonate Parts | Aqueous solution: Sodium laurate Parts | Physical property D50 [μm] |
|---|---|---|---|---|---|---|
| 20 | 300 | 20 | 100 | 5 | 10 | 0.4 |
| 21 | 300 | 21 | 100 | 5 | 10 | 0.4 |
| 22 | 300 | 22 | 100 | 5 | 10 | 0.4 |
| 23 | 300 | 23 | 100 | 5 | 10 | 0.4 |
| 24 | 300 | 24 | 100 | 5 | 10 | 0.4 |
| 25 | 300 | 25 | 100 | 5 | 10 | 0.4 |
| 26 | 300 | 26 | 100 | 5 | 10 | 0.4 |
| 27 | 300 | 27 | 100 | 5 | 10 | 0.4 |
| 28 | 300 | 28 | 100 | 5 | 10 | 0.4 |
| 29 | 300 | 29 | 100 | 5 | 10 | 0.4 |
| 30 | 300 | 30 | 100 | 5 | 10 | 0.4 |

Production Example of Dispersion Solution of Amorphous Resin Fine Particles 1 Other than Polymer A

| | |
|---|---|
| Tetrahydrofuran (manufactured by Wako Pure Chemical Industries, Ltd.) | 300 parts |
| Amorphous resin 1 other than polymer A | 100 parts |
| Anion surfactant NEOGEN RK (manufactured by Daiichi Kogyo Seiyaku Co., Ltd.) | 0.5 part |

The above materials were weighed, mixed and dissolved. Then, 20.0 parts of 1 mol/L ammonia water was added and the components were stirred at 4000 rpm by using an ultrahigh-speed stirring device T. K. ROBOMIX (manufactured by PRIMIX Corporation). A total of 700 parts of ion exchanged water was thereafter added at a rate of 8 g/min to precipitate amorphous resin fine particles other than the polymer A. Thereafter, tetrahydrofuran was removed using an evaporator, the concentration was adjusted with ion exchanged water, and an aqueous dispersion solution (dispersion solution of amorphous resin fine particles 1) having the concentration of the amorphous resin fine particles 1 other than the polymer A of 20% by mass was obtained.

The 50% particle size (D50), based on the volume distribution, of the amorphous resin fine particles 1 other than the polymer A was 0.13 μm.

Production Example of Release Agent (Aliphatic Hydrocarbon Compound) Fine Particle-Dispersed Solution

| | |
|---|---|
| Aliphatic hydrocarbon compound HNP-51 (manufactured by Nippon Seiro Co., Ltd.) | 100 parts |
| Anionic surfactant NEOGEN RK (manufactured by Daiichi Kogyo Seiyaku Co., Ltd.) | 5 parts |
| Ion exchanged water | 395 parts |

The above materials were weighed, charged into a mixing vessel equipped with a stirrer, heated to 90° C., circulated to CLEARMIX W MOTION (manufactured by M Technique Co., Ltd.) and dispersion treated for 60 min. The conditions of the dispersion treatment were as follows.

Rotor outer diameter: 3 cm

Clearance: 0.3 mm

Rotor revolution speed: 19,000 r/min

Screen revolution speed: 19,000 r/min

After the dispersion treatment, cooling to 40° C. was performed under cooling treatment conditions of a rotor revolution speed of 1000 r/min, a screen revolution speed of 0 r/min, and a cooling rate of 10° C./min to obtain an aqueous dispersion solution (release agent (aliphatic hydrocarbon compound) fine particle-dispersed solution) having the concentration of release agent (aliphatic hydrocarbon compound) fine particles of 20% by mass.

The 50% particle size (D50), based on volume distribution, of the release agent (aliphatic hydrocarbon compound) fine particles was measured using a dynamic light scattering type particle size distribution meter NANOTRAC UPA-EX150 (manufactured by Nikkiso Co., Ltd.), and the result was 0.15 μm.

<Production of Colorant Fine Particle-Dispersed Solution>

| | |
|---|---|
| Colorant (Cyan pigment manufactured by Dainichiseika Color & Chemicals Mfg. Co., Ltd.: Pigment Blue 15:3) | 50.0 parts |
| Anionic surfactant NEOGEN RK (manufactured by Daiichi Kogyo Seiyaku Co., Ltd.) | 7.5 parts |
| Ion-exchanged water | 442.5 parts |

The above materials were weighed and mixed, dissolved, and dispersed for about 1 h using a high-pressure impact type dispersing machine NANOMIZER (manufactured by Yoshida Kikai Co., Ltd.) to obtain an aqueous dispersion solution (colorant-fine particle-dispersed solution) in which the colorant was dispersed and the concentration of colorant fine particles was 10% by mass.

The 50% particle size (D50), based on volume distribution, of the colorant fine particles was measured using a dynamic light scattering type particle size distribution meter NANOTRAC UPA-EX150 (manufactured by Nikkiso Co., Ltd.), and the result was 0.20 μm.

Production Example of Toner 1

| | |
|---|---|
| Dispersion solution of polymer fine particles 1 | 500 parts |
| Release agent (aliphatic hydrocarbon compound fine particle-dispersed solution) | 50 parts |

-continued

| | |
|---|---|
| Colorant fine particle-dispersed solution | 80 parts |
| Ion exchanged water | 160 parts |

The materials were charged into a round stainless steel flask and mixed, and then 10 parts of a 10% aqueous solution of magnesium sulfate was added. Subsequently, dispersion was performed for 10 min at 5000 r/min by using a homogenizer ULTRA-TURRAX T50 (manufactured by IKA). Thereafter, the mixture was heated in a heating water bath to 58° C. while using a stirring blade and appropriately adjusting the revolution speed such that the mixture was stirred.

The volume average particle diameter of the formed aggregated particles was appropriately confirmed using Coulter Multisizer III, and when the aggregated particles having a volume average particle diameter of about 6.00 μm were formed, 100 parts of sodium ethylenediaminetetraacetate was added, followed by heating to 75° C. while continuing to stir. Then, the aggregated particles were fused by holding at 75° C. for 1 h.

Then, cooling was performed to 50° C. and crystallization of the polymer was promoted by holding for 3 h.

Thereafter, as a step of removing polyvalent metal ions derived from the flocculant was performed by washing with a 5% aqueous solution of sodium ethylenediaminetetraacetate while maintaining the temperature of 50° C.

Thereafter, cooling to 25° C., filtering and solid-liquid separation were performed followed by washing with ion exchanged water. After washing, the toner particles 1 having a weight average particle diameter (D4) of about 6.07 were obtained by drying using a vacuum drier.

| | |
|---|---|
| Toner particles 1 | 100 parts |
| Large-diameter silica fine particles surface-treated with hexamethyldisilazane (average particle diameter 130 nm) | 3 parts |
| Small-diameter silica fine particles surface-treated with hexamethyldisilazane (average particle diameter 20 nm) | 1 part |

A toner 1 was obtained by mixing the above materials with a Henschel mixer FM-10C (manufactured by Nippon Coke & Engineering Co., Ltd.) at a revolution speed of 30 $s^{-1}$ and a revolution time of 10 min. The constituent materials of toner 1 are shown in Table 6.

The weight average particle diameter (D4) of the toner 1 was 6.1 μm, and the average circularity was 0.975. Physical properties of the toner 1 are shown in Table 7.

TABLE 6

| | Formulation and production method | | | | | | | |
|---|---|---|---|---|---|---|---|---|
| | Polymer fine particle-dispersed solution | | Amorphous resin fine particle-dispersed solution other than polymer A | | Flocculant | | Removal agent | |
| Toner | Type | Parts | Type | Parts | Type | Parts | Type | Temperature [° C.] |
| 1 | 1 | 500 | — | — | Mg | 10 | Na | 50 |
| 2 | 1 | 500 | — | — | Mg | 10 | Na | 70 |
| 3 | 1 | 500 | — | — | Ca | 10 | Na | 70 |
| 4 | 1 | 500 | — | — | Zn | 10 | Na | 70 |
| 5 | 1 | 500 | — | — | Al | 7 | Na | 70 |
| 6 | 1 | 500 | — | — | Mg | 10 | Li | 70 |
| 7 | 1 | 500 | — | — | Mg | 10 | K | 70 |
| 8 | 1 | 500 | — | — | Mg | 10 | Na | 40 |
| 9 | 1 | 500 | — | — | Mg | 10 | Na | 80 |
| 10 | 1 | 500 | — | — | Mg | 10 | Na | 30 |
| 11 | 2 | 500 | — | — | Mg | 10 | Na | 30 |
| 12 | 3 | 500 | — | — | Mg | 10 | Na | 30 |
| 13 | 4 | 500 | — | — | Mg | 10 | Na | 30 |
| 14 | 5 | 500 | — | — | Mg | 10 | Na | 30 |
| 15 | 6 | 500 | — | — | Mg | 10 | Na | 30 |
| 16 | 7 | 500 | — | — | Mg | 10 | Na | 30 |
| 17 | 8 | 500 | — | — | Mg | 10 | Na | 30 |
| 18 | 9 | 500 | — | — | Mg | 10 | Na | 30 |
| 19 | 10 | 500 | — | — | Mg | 10 | Na | 30 |
| 20 | 11 | 500 | — | — | Mg | 10 | Na | 30 |
| 21 | 12 | 500 | — | — | Mg | 10 | Na | 30 |
| 22 | 13 | 500 | — | — | Mg | 10 | Na | 30 |
| 23 | 14 | 500 | — | — | Mg | 10 | Na | 30 |
| 24 | 15 | 500 | — | — | Mg | 10 | Na | 30 |
| 25 | 16 | 500 | — | — | Mg | 10 | Na | 30 |
| 26 | 17 | 500 | — | — | Mg | 10 | Na | 30 |
| 27 | 18 | 500 | — | — | Mg | 10 | Na | 30 |
| 28 | 19 | 500 | — | — | Mg | 10 | Na | 30 |
| 29 | 20 | 500 | — | — | Mg | 10 | Na | 30 |
| 30 | 21 | 500 | — | — | Mg | 10 | Na | 30 |
| 31 | 1 | 255 | 1 | 245 | Mg | 10 | Na | 30 |
| 32 | 1 | 200 | 1 | 300 | Mg | 10 | Na | 30 |
| 33 | Separate note | | | | | | | |
| 34 | 22 | 500 | — | — | Mg | 10 | Na | 30 |
| 35 | 23 | 500 | — | — | Mg | 10 | Na | 30 |
| 36 | 24 | 500 | — | — | Mg | 10 | Na | 30 |
| 37 | 25 | 500 | — | — | Mg | 10 | Na | 30 |
| 38 | 26 | 500 | — | — | Mg | 10 | Na | 30 |

TABLE 6-continued

| | Formulation and production method | | | | | | | |
|---|---|---|---|---|---|---|---|---|
| | Polymer fine particle-dispersed solution | | Amorphous resin fine particle-dispersed solution other than polymer A | | Flocculant | | Removal agent | |
| Toner | Type | Parts | Type | Parts | Type | Parts | Type | Temperature [° C.] |
| 39 | 1 | 500 | — | — | Mg | 10 | Na | 90 |
| 40 | 1 | 500 | — | — | Mg | 10 | Na | 20 |
| 41 | 27 | 500 | — | — | Mg | 10 | Na | 30 |
| 42 | 28 | 500 | — | — | Mg | 10 | Na | 30 |
| 43 | 29 | 500 | — | — | Mg | 10 | Na | 30 |
| 44 | 30 | 500 | — | — | Mg | 10 | Na | 30 |

The abbreviations in Table 6 are as follows.
Mg: magnesium sulfate
Ca: calcium nitrate
Zn: zinc chloride
Al: aluminum sulfate
Na: sodium ethylenediaminetetraacetate
Li: lithium citrate
K: potassium citrate

TABLE 7

| | Physical properties | | | | | | | | | |
|---|---|---|---|---|---|---|---|---|---|---|
| Toner | Amount of polyvalent metal [ppm] | Amount of monovalent metal [ppm] | Monovalent metal ratio [% by mass] | Weight average particle diameter D4 [μm] | Complex elastic modulus at 65° C., $\times 10^7$ [Pa] | Complex elastic modulus at 85° C., $\times 10^5$ [Pa] | Metal domain diameter [nm]*1 | (Amount of metal)/(Second unit) [—] | (Surface metal concentration/(Internal metal concentration) [—] | Average circularity |
| 1 | 200 | 300 | 60 | 6.1 | 4.10 | 0.90 | 30 | 3.7 | 0.8 | 0.975 |
| 2 | 25 | 225 | 90 | 6.1 | 3.00 | 0.90 | 30 | 0.5 | 0.4 | 0.975 |
| 3 | 25 | 225 | 90 | 6.1 | 3.00 | 0.92 | 30 | 0.5 | 0.4 | 0.975 |
| 4 | 25 | 225 | 90 | 6.1 | 3.00 | 0.92 | 30 | 0.5 | 0.4 | 0.975 |
| 5 | 25 | 225 | 90 | 6.1 | 2.90 | 0.95 | 30 | 0.5 | 0.4 | 0.975 |
| 6 | 25 | 225 | 90 | 6.1 | 3.00 | 0.92 | 30 | 0.5 | 0.4 | 0.975 |
| 7 | 25 | 225 | 90 | 6.1 | 3.00 | 0.92 | 30 | 0.5 | 0.4 | 0.975 |
| 8 | 250 | 250 | 50 | 6.1 | 3.00 | 0.92 | 30 | 4.6 | 0.9 | 0.975 |
| 9 | 25 | 475 | 95 | 6.1 | 3.00 | 0.90 | 30 | 0.5 | 0.4 | 0.975 |
| 10 | 500 | 214 | 30 | 6.1 | 2.70 | 0.95 | 30 | 9.3 | 1.1 | 0.975 |
| 11 | 500 | 214 | 30 | 6.1 | 2.70 | 0.95 | 30 | 8.4 | 1.1 | 0.975 |
| 12 | 500 | 214 | 30 | 6.1 | 2.70 | 0.95 | 30 | 9.1 | 1.1 | 0.975 |
| 13 | 500 | 214 | 30 | 6.1 | 2.70 | 0.97 | 30 | 8.8 | 1.1 | 0.975 |
| 14 | 500 | 214 | 30 | 6.1 | 3.00 | 1.30 | 30 | 8.9 | 1.1 | 0.975 |
| 15 | 500 | 214 | 30 | 6.1 | 3.00 | 1.50 | 30 | 8.9 | 1.1 | 0.975 |
| 16 | 500 | 214 | 30 | 6.1 | 1.00 | 0.95 | 20 | 23.4 | 1.1 | 0.975 |
| 17 | 500 | 214 | 30 | 6.1 | 3.00 | 0.95 | 20 | 8.6 | 1.1 | 0.975 |
| 18 | 500 | 214 | 30 | 6.1 | 1.00 | 0.95 | 10 | 8.6 | 1.1 | 0.975 |
| 19 | 500 | 214 | 30 | 6.1 | 1.00 | 0.95 | 30 | 12.1 | 1.1 | 0.975 |
| 20 | 500 | 214 | 30 | 6.1 | 5.10 | 1.30 | 20 | 5.6 | 1.1 | 0.975 |
| 21 | 500 | 214 | 30 | 6.1 | 3.00 | 1.50 | 20 | 7.5 | 1.1 | 0.975 |
| 22 | 500 | 214 | 30 | 6.1 | 2.00 | 0.95 | 45 | 21.7 | 1.1 | 0.975 |
| 23 | 500 | 214 | 30 | 6.1 | 1.00 | 1.30 | 55 | 23.8 | 1.1 | 0.975 |
| 24 | 500 | 214 | 30 | 6.1 | 2.00 | 0.95 | 10 | 9.8 | 1.1 | 0.975 |
| 25 | 500 | 214 | 30 | 6.1 | 3.00 | 1.30 | 10 | 8.7 | 1.1 | 0.975 |
| 26 | 500 | 214 | 30 | 6.1 | 3.00 | 1.30 | 10 | 8.8 | 1.1 | 0.975 |
| 27 | 500 | 214 | 30 | 6.1 | 2.00 | 0.95 | 20 | 14.6 | 1.1 | 0.975 |
| 28 | 500 | 214 | 30 | 6.1 | 2.00 | 0.95 | 20 | 9.8 | 1.1 | 0.975 |
| 29 | 500 | 214 | 30 | 6.1 | 2.00 | 0.95 | 20 | 9.4 | 1.1 | 0.975 |
| 30 | 500 | 214 | 30 | 6.1 | 2.00 | 0.95 | 20 | 9.4 | 1.1 | 0.975 |
| 31 | 500 | 214 | 30 | 6.1 | 3.00 | 0.99 | 5 | 9.3 | 1.1 | 0.975 |
| 32 | 500 | 214 | 30 | 6.1 | 4.00 | 2.20 | 3 | 9.3 | 1.1 | 0.975 |
| 33 | 500 | 0 | 0 | 6.1 | 1.00 | 0.98 | 8 | 9.3 | 1.1 | 0.975 |
| 34 | 500 | 214 | 30 | 6.1 | 0.87 | 0.97 | 0 | 39.7 | 1.1 | 0.975 |
| 35 | 500 | 214 | 30 | 6.1 | 0.89 | 0.97 | 30 | 12.9 | 1.1 | 0.975 |
| 36 | 500 | 214 | 30 | 6.1 | 0.82 | 0.97 | 20 | 27.5 | 1.1 | 0.975 |
| 37 | 500 | 214 | 30 | 6.1 | 0.82 | 0.97 | 30 | 9.3 | 1.1 | 0.975 |
| 38 | 500 | 214 | 30 | 6.1 | 0.82 | 0.97 | 30 | 0.0 | 1.1 | 0.975 |
| 39 | 0 | 500 | 100 | 6.1 | 0.82 | 0.90 | 30 | 0.0 | 0.2 | 0.975 |
| 40 | 520 | 130 | 20 | 6.1 | 0.89 | 0.97 | 30 | 9.7 | 1.1 | 0.975 |
| 41 | 500 | 214 | 30 | 6.1 | 4.00 | 2.20 | 20 | 8.1 | 1.1 | 0.975 |

TABLE 7-continued

| Toner | Physical properties | | | | | | | | | |
|---|---|---|---|---|---|---|---|---|---|---|
| | Amount of polyvalent metal [ppm] | Amount of monovalent metal [ppm] | Monovalent metal ratio [% by mass] | Weight average particle diameter D4 [μm] | Complex elastic modulus at 65° C., $\times 10^7$ [Pa] | Complex elastic modulus at 85° C., $\times 10^5$ [Pa] | Metal domain diameter [nm]*1 | (Amount of metal)/(Second unit) [—] | (Surface metal concentration/(Internal metal concentration) [—] | Average circularity |
| 42 | 500 | 214 | 30 | 6.1 | 3.00 | 2.60 | 0 | 7.9 | 1.1 | 0.975 |
| 43 | 500 | 214 | 30 | 6.1 | 3.00 | 2.80 | 0 | 5.5 | 1.1 | 0.975 |
| 44 | 500 | 214 | 30 | 6.1 | 2.90 | 2.70 | 0 | 27.5 | 1.1 | 0.975 |

*1: "Metal domain diameter" in the table indicates the domain diameter of at least one of polyvalent metal and monovalent metal.

Production Examples of Toners 2 to 32 and 34 to 44

Toners 2 to 32 and 34 to 44 were obtained by performing the same operations as in the production example of toner 1, except that the type and amount of dispersion solution of the polymer fine particles 1, the amount of amorphous resin fine particles 1 other than the polymer A, the type and amount added of the flocculant, the type of the removal agent, and the addition temperature of the removal agent in the production example of toner 1 were changed as shown in Table 6. Physical properties are shown in Table 7.

Production Example of Toner 33

| | |
|---|---|
| Polymer A1 | 100.0 parts |
| Aliphatic hydrocarbon compound HNP-51 (manufactured by Nippon Seiro Co., Ltd.) | 10.0 parts |
| Colorant (Cyan pigment manufactured by Dainichiseika Color & Chemicals Mfg. Co., Ltd.: Pigment Blue 15:3) | 8.0 parts |
| 3,5-di-t-Butyl salicylate aluminum compound | 0.03 part |

The above materials were mixed at a revolution speed of 20 $s^{-1}$ and a revolution time of 5 min using a Henschel mixer (type FM-75, manufactured by Mitsui Mining Co., Ltd.) and then melt-kneaded with a two-shaft kneader (PCM-30, manufactured by Ikegai Co., Ltd.) that was set to a temperature of 130° C.

The obtained kneaded product was cooled and coarsely pulverized to 1 mm or less with a hammer mill to obtain a coarsely pulverized product.

The obtained coarsely pulverized product was finely pulverized with a mechanical pulverizer (T-250, manufactured by Turbo Kogyo Co., Ltd.).

Further, classification was carried out using FACULTY F-300 (manufactured by Hosokawa Micron Corporation) to obtain toner particles 33 having a weight average particle diameter (D4) of about 6.07 μm. The operation conditions were such that the classification rotor revolution speed was 130 $s^{-1}$ and the dispersion rotor revolution speed was 120 $s^{-1}$.

| | |
|---|---|
| Toner particles 33 | 100 parts |
| Large-diameter silica fine particles surface-treated with hexamethyldisilazane (average particle diameter 130 nm) | 3 parts |
| Small-diameter silica fine particles surface-treated with hexamethyldisilazane (average particle diameter 20 nm) | 1 part |

A toner 33 was obtained by mixing the above materials with a Henschel mixer FM-10C (manufactured by Nippon Coke & Engineering Co., Ltd.) at a revolution speed of 30 $s^{-1}$ and a revolution time of 10 min. The weight average particle diameter (D4) of the toner 33 was 6.1 μm, and the average circularity was 0.975. Physical properties of the toner 33 are shown in Table 7.

Production Example of Magnetic Carrier 1

Magnetite 1 having a number average particle size of 0.30 μm (magnetization intensity of 65 $Am^2/kg$ under a magnetic field of (1000/4π (kA/m))

Magnetite 2 having a number average particle size of 0.50 μm (magnetization intensity of 65 $Am^2/kg$ under a magnetic field of (1000/4π (kA/m))

A total of 4.0 parts of a silane compound (3-(2-aminoethylaminopropyl)trimethoxysilane) was added to 100 parts of each of the above materials, and high-speed mixing and stirring was carried out at a temperature of 100° C. or higher in a container to treat the respective fine particles.

Phenol: 10% by mass

Formaldehyde solution: 6% by mass (40% by mass of formaldehyde, 10% by mass of methanol, 50% by mass of water)

Magnetite 1 treated with the above silane compound: 58% by mass

Magnetite 2 treated with the above silane compound: 26% by mass

A total of 100 parts of the above materials, 5 parts of a 28% by mass aqueous ammonia solution, and 20 parts of water were placed in a flask, heated to 85° C. over 30 min while stirring and mixing, and held for 3 h to cause a polymerization reaction and cure the generated phenolic resin.

Thereafter, the cured phenolic resin was cooled to 30° C., water was further added, the supernatant was removed, and the precipitate was washed with water and then air dried. Subsequently, the resulting product was dried at a temperature of 60° C. under reduced pressure (5 mmHg or less) to obtain a spherical magnetic carrier 1 of a magnetic substance dispersion type. The volume-based 50% particle diameter (D50) was 34.21 μm.

Production Example of Two-Component Developer 1

A total of 92.0 parts of the magnetic carrier 1 and 8.0 parts of the toner 1 were mixed with a V-type mixer (V-20, manufactured by Seishin Enterprise Co., Ltd.) to obtain a two-component developer 1.

Production Examples of Two-Component Developers 2 to 44

Two-component developers 2 to 44 were obtained by carrying out the same operations as in the production example of two-component developer 1, except that changes such as shown in Table 8 were made.

TABLE 8

| | Two-component developer | Toner | Magnetic carrier |
|---|---|---|---|
| Example 1 | 1 | 1 | 1 |
| Example 2 | 2 | 2 | 1 |
| Example 3 | 3 | 3 | 1 |
| Example 4 | 4 | 4 | 1 |
| Example 5 | 5 | 5 | 1 |
| Example 6 | 6 | 6 | 1 |
| Example 7 | 7 | 7 | 1 |
| Example 8 | 8 | 8 | 1 |
| Example 9 | 9 | 9 | 1 |
| Example 10 | 10 | 10 | 1 |
| Example 11 | 11 | 11 | 1 |
| Example 12 | 12 | 12 | 1 |
| Example 13 | 13 | 13 | 1 |
| Example 14 | 14 | 14 | 1 |
| Example 15 | 15 | 15 | 1 |
| Example 16 | 16 | 16 | 1 |
| Example 17 | 17 | 17 | 1 |
| Example 18 | 18 | 18 | 1 |
| Example 19 | 19 | 19 | 1 |
| Example 20 | 20 | 20 | 1 |
| Example 21 | 21 | 21 | 1 |
| Example 22 | 22 | 22 | 1 |
| Example 23 | 23 | 23 | 1 |
| Example 24 | 24 | 24 | 1 |
| Example 25 | 25 | 25 | 1 |
| Example 26 | 26 | 26 | 1 |
| Example 27 | 27 | 27 | 1 |
| Example 28 | 28 | 28 | 1 |
| Example 29 | 29 | 29 | 1 |
| Example 30 | 30 | 30 | 1 |
| Example 31 | 31 | 31 | 1 |
| Example 32 | 32 | 32 | 1 |
| Example 33 | 33 | 33 | 1 |
| Example 34 | 41 | 41 | 1 |
| Comparative Example 1 | 34 | 34 | 1 |
| Comparative Example 2 | 35 | 35 | 1 |
| Comparative Example 3 | 36 | 36 | 1 |
| Comparative Example 4 | 37 | 37 | 1 |
| Comparative Example 5 | 38 | 38 | 1 |
| Comparative Example 6 | 39 | 39 | 1 |
| Comparative Example 7 | 40 | 40 | 1 |
| Comparative Example 8 | 42 | 42 | 1 |
| Comparative Example 9 | 43 | 43 | 1 |
| Comparative Example 10 | 44 | 44 | 1 |

Example 1

Evaluation was performed using the two-component developer 1 described above.

A modified printer imageRUNNER ADVANCE C5560 for digital commercial printing manufactured by Canon Inc. was used as an image forming apparatus, and the two-component developer 1 was placed in a developing device at a cyan position. The modification of the apparatus involved changes that enabled free setting of the fixing temperature, process speed, DC voltage $V_{DC}$ of the developer bearing member, charging voltage $V_D$ of the electrostatic latent image bearing member, and laser power. In the image output evaluation, an FFh image (solid image) of a desired image ratio was outputted, $V_{DC}$, $V_D$, and laser power were adjusted so as to obtain the desired toner laid-on level on the FFh image on the paper, and the following evaluation was performed.

The FFh is a value obtained by hexadecimal representation of 256 gradations, 00h being the first gradation (white area) of 256 gradations, and FFh being the 256 gradations (solid portion) of 256 gradations.

The evaluation was based on the following evaluation methods, and the results are shown in Table 9.

[Developing Performance]

Paper: CS-680 (68.0 g/m$^2$)
(marketed by Canon Marketing Japan Co., Ltd.)
Toner laid-on level on paper: 0.35 mg/cm$^2$ (FFh image)
(adjusted by the DC voltage $V_{DC}$ of the developer bearing member, the charging voltage $V_D$ of the electrostatic latent image bearing member, and the laser power)
Evaluation image: ruled line chart with an image ratio of 5% on the entire surface of the A4 sheet
Test environment: high-temperature and high-humidity environment (temperature 30° C./humidity 80% RH (hereinafter H/H))
Process speed: 377 mm/sec A total of 100,000 prints of the evaluation image was outputted, and the developing performance was evaluated. When a development stripe occurs, a longitudinal stripe-shaped stain appears on the paper. Visual evaluation of the state was used as an evaluation index of developing performance. Where the evaluation was A to D, it was determined that the effects of the present invention were obtained.

A: no longitudinal stripes on paper
B: one or two longitudinal stripes on paper
C: 3 or 4 longitudinal stripes on paper
D: 5 or 6 longitudinal stripes on paper
E: 7 or more longitudinal stripes on paper

[Low-Temperature Fixability]

Paper: GFC-081 (81.0 g/m$^2$)
(marketed by Canon Marketing Japan Co., Ltd.)
Toner laid-on level on paper: 0.50 mg/cm$^2$
(adjusted by the DC voltage $V_{DC}$ of the developer bearing member, the charging voltage $V_D$ of the electrostatic latent image bearing member, and the laser power)
Evaluation image: a 2 cm×5 cm image is placed at the center of the A4 paper
Test environment: low-temperature and low-humidity environment: temperature 15° C./humidity 10% RH (hereinafter "L/L")
Fixing temperature: 150° C.
Process speed: 377 mm/sec The evaluation image was outputted to evaluate the low-temperature fixability. The value of the image density reduction rate was used as an evaluation index of low-temperature fixability.

First, the image density reduction rate was determined by measuring the image density at the center by using an X-Rite color reflection densitometer (500 series: manufactured by X-Rite Co., Ltd.). Next, a load of 4.9 kPa (50 g/cm$^2$) was applied to the portion where the image density has been measured, and the fixed image was rubbed (five reciprocations) with Silbon paper, and the image density was measured again.

Then, the reduction rate of the image density before and after the rubbing was calculated using the following equation. The obtained image density reduction rate was evaluated according to the following evaluation criteria. Where the evaluation was A to D, it was determined that the effects of the present invention were obtained.

Image density reduction rate=[(image density before rubbing)−(image density after rubbing)]/(image density before rubbing)×100

(Evaluation Criteria)

A: image density reduction rate is less than 3%

B: image density reduction rate is 3%, or more and less than 5%

C: image density reduction rate is 5%, or more and less than 8%

D: image density reduction rate is 8%, or more and less than 13%

E: image density reduction rate is 13% or more

[Charge Retention Ratio Under High-Temperature and High-Humidity Environment]

Paper: GFC-081 (81.0 g/m$^2$) (Canon Marketing Japan Co., Ltd.)

Toner lain-on level on the paper: 0.35 mg/cm$^2$ (Adjustment by the DC voltage $V_{DC}$ of the developer bearing member, the charging voltage $V_D$ of the electrostatic latent image bearing member, and the laser power)

Evaluation image: an image of 2 cm×5 cm placed at the center of the A4 paper

Fixing test environment: high-temperature and high-humidity environment: temperature 30° C./humidity 80% RH (hereinafter "H/H")

Process speed: 377 mm/sec

The toner on the electrostatic latent image bearing member was sucked in and collected using a metal cylindrical tube and a cylindrical filter to calculate the triboelectric charge quantity of the toner. Specifically, the triboelectric charge quantity of the toner on the electrostatic latent image bearing member was measured by a Faraday-Cage.

The Faraday-Cage is a coaxial double cylinder in which the inner cylinder and the outer cylinder are insulated from each other. Where a charged body with a charge quantity Q is inserted into this inner cylinder, it is as if a metal cylinder of the charge quantity Q is present as a result of electrostatic induction. The induced charge quantity was measured by an electrometer (KEITHLEY 6517A, manufactured by Keithley Instruments Co., Ltd.), and the ratio (Q/M) obtained by dividing the charge quantity Q (mC) by the toner amount M (kg) in the inner cylinder was taken as the triboelectric charge quantity of the toner.

$$\text{Triboelectric charge quantity of toner (mC/kg)} = Q/M$$

First, the evaluation image was formed on the electrostatic latent image bearing member, the rotation of the electrostatic latent image bearing member was stopped before the image was transferred to the intermediate transfer member, the toner on the electrostatic latent image bearing member was sucked in and collected with a metallic cylindrical tube and a cylindrical filter, and the [initial Q/M] was measured.

Subsequently, the developing device was allowed to stand in the evaluation machine for 2 weeks in the H/H environment, then the same operations as before the storage were performed, and the charge quantity Q/M (mC/kg) per unit mass on the electrostatic latent image bearing member after the storage was measured. The initial Q/M per unit mass on the electrostatic latent image bearing member was taken as 100%, and the retention rate of Q/M per unit mass on the electrostatic latent image bearing member after the storage ([Q/M after the storage]/[initial Q/M]×100) was calculated and determined based on the following criteria. Where the evaluation was A to D, it was determined that the effects of the present invention were obtained.

(Evaluation Criteria)

A: retention rate is 95% or more

B: retention rate is 90% or more, and less than 95%

C: retention rate is 85% or more, and less than 90%

D: retention rate is 80% or more, and less than 85%

E: retention rate less than 80%

Examples 2 to 34 and Comparative Examples 1 to 10

The evaluation was performed in the same manner as in Example 1 except that two-component developers 2 to 44 were used. The evaluation results are shown in Table 9.

TABLE 9

| | Low-temperature fixability | | | | Developing performance | | Charge retention ratio | | | |
|---|---|---|---|---|---|---|---|---|---|---|
| | Evaluation | Image density before rubbing | Image density after rubbing | Reduction rate | Evaluation | Number of Development stripe | Evaluation | Q/M (mC/kg) Before being allowed to stand | Q/M (mC/kg) After being allowed to stand | Retention rate |
| Example 1 | A | 1.35 | 1.35 | 0% | A | 0 | A | 36 | 36 | 100% |
| Example 2 | A | 1.35 | 1.35 | 0% | B | 1 | A | 36 | 35 | 97% |
| Example 3 | A | 1.35 | 1.34 | 1% | B | 1 | A | 36 | 35 | 97% |
| Example 4 | A | 1.35 | 1.34 | 1% | B | 1 | A | 36 | 35 | 97% |
| Example 5 | A | 1.35 | 1.32 | 2% | B | 2 | B | 36 | 34 | 94% |
| Example 6 | A | 1.35 | 1.34 | 1% | B | 1 | A | 36 | 35 | 97% |
| Example 7 | A | 1.35 | 1.34 | 1% | B | 1 | A | 36 | 35 | 97% |
| Example 8 | A | 1.35 | 1.32 | 2% | B | 1 | B | 36 | 34 | 94% |
| Example 9 | A | 1.35 | 1.35 | 0% | B | 2 | B | 36 | 34 | 94% |
| Example 10 | B | 1.35 | 1.30 | 4% | B | 2 | B | 36 | 33 | 92% |
| Example 11 | B | 1.35 | 1.30 | 4% | B | 2 | B | 36 | 33 | 92% |
| Example 12 | B | 1.35 | 1.30 | 4% | B | 2 | C | 36 | 32 | 89% |
| Example 13 | C | 1.35 | 1.28 | 5% | B | 2 | B | 36 | 33 | 92% |
| Example 14 | D | 1.35 | 1.21 | 10% | B | 1 | B | 36 | 34 | 94% |
| Example 15 | D | 1.35 | 1.20 | 11% | B | 1 | B | 36 | 34 | 94% |
| Example 16 | B | 1.35 | 1.30 | 4% | C | 3 | D | 36 | 30 | 83% |
| Example 17 | B | 1.35 | 1.30 | 4% | B | 2 | B | 36 | 33 | 92% |
| Example 18 | B | 1.35 | 1.30 | 4% | C | 3 | C | 36 | 32 | 89% |
| Example 19 | B | 1.35 | 1.30 | 4% | C | 3 | C | 36 | 32 | 89% |
| Example 20 | D | 1.35 | 1.21 | 10% | B | 1 | B | 36 | 34 | 94% |
| Example 21 | D | 1.35 | 1.20 | 11% | B | 1 | B | 36 | 34 | 94% |
| Example 22 | B | 1.35 | 1.30 | 4% | B | 2 | B | 36 | 33 | 92% |
| Example 23 | D | 1.35 | 1.20 | 11% | C | 3 | C | 36 | 32 | 89% |
| Example 24 | B | 1.35 | 1.30 | 4% | B | 2 | B | 36 | 33 | 92% |

TABLE 9-continued

| | Low-temperature fixability | | | | Developing performance | | Charge retention ratio | | | |
|---|---|---|---|---|---|---|---|---|---|---|
| | Evaluation | Image density before rubbing | Image density after rubbing | Reduction rate | Evaluation | Number of Development stripe | Evaluation | Q/M (mC/kg) Before being allowed to stand | Q/M (mC/kg) After being allowed to stand | Retention rate |
| Example 25 | D | 1.35 | 1.19 | 12% | B | 2 | B | 36 | 33 | 92% |
| Example 26 | D | 1.35 | 1.19 | 12% | B | 2 | B | 36 | 33 | 92% |
| Example 27 | B | 1.35 | 1.30 | 4% | B | 2 | C | 36 | 32 | 89% |
| Example 28 | B | 1.35 | 1.30 | 4% | B | 2 | C | 36 | 32 | 89% |
| Example 29 | B | 1.35 | 1.30 | 4% | B | 2 | B | 36 | 33 | 92% |
| Example 30 | B | 1.35 | 1.30 | 4% | B | 2 | B | 36 | 33 | 92% |
| Example 31 | C | 1.35 | 1.28 | 5% | B | 1 | B | 36 | 34 | 94% |
| Example 32 | D | 1.35 | 1.19 | 12% | A | 0 | A | 36 | 35 | 97% |
| Example 33 | B | 1.35 | 1.30 | 4% | C | 3 | C | 36 | 32 | 89% |
| Example 34 | D | 1.35 | 1.19 | 12% | B | 1 | B | 36 | 34 | 94% |
| Comparative Example 1 | B | 1.35 | 1.30 | 4% | E | 7 | C | 36 | 31 | 86% |
| Comparative Example 2 | B | 1.35 | 1.30 | 4% | D | 5 | E | 36 | 28 | 78% |
| Comparative Example 3 | B | 1.35 | 1.30 | 4% | E | 7 | D | 36 | 30 | 83% |
| Comparative Example 4 | B | 1.35 | 1.30 | 4% | E | 7 | C | 36 | 32 | 89% |
| Comparative Example 5 | B | 1.35 | 1.30 | 4% | E | 8 | E | 36 | 28 | 78% |
| Comparative Example 6 | A | 1.35 | 1.35 | 0% | E | 8 | D | 36 | 30 | 83% |
| Comparative Example 7 | D | 1.35 | 1.20 | 11% | E | 7 | C | 36 | 32 | 89% |
| Comparative Example 8 | E | 1.35 | 1.18 | 13% | B | 1 | B | 36 | 34 | 94% |
| Comparative Example 9 | E | 1.35 | 1.11 | 18% | A | 0 | A | 36 | 35 | 97% |
| Comparative Example 10 | E | 1.35 | 1.11 | 18% | C | 3 | C | 36 | 32 | 89% |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-113139, filed, Jun. 13, 2018, and Japanese Patent Application No. 2019-074931, filed, Apr. 10, 2019, which are hereby incorporated by reference herein in their entirety.

What is claimed is:

1. A toner comprising a toner particle including a binder resin, wherein the binder resin includes a polymer A, the polymer A contains a first monomer unit derived from a first polymerizable monomer, and a second monomer unit derived from a second polymerizable monomer different from the first polymerizable monomer;

the first polymerizable monomer is at least one selected from the group consisting of (meth)acrylic acid esters having an alkyl group having 18 to 36 carbon atoms;

a content of the first monomer unit in the polymer A is 5.0 mol % to 60.0 mol %, based on the total number of moles of all the monomer units in the polymer A;

a content of the second monomer unit in the polymer A is 20.0 mol % to 95.0 mol %, based on the total number of moles of all the monomer units in the polymer A;

where an SP value of the first monomer unit is denoted by $SP_{11}$ $(J/cm^3)^{0.5}$ and an SP value of the second monomer unit is denoted by $SP_{21}$ $(J/cm^3)^{0.5}$, following formulas (1) and (2) are satisfied;

the polymer A includes a polyvalent metal;

the polyvalent metal is at least one selected from the group consisting of Mg, Ca, Al, and Zn; and a content of the polyvalent metal in the toner particle is 25 ppm to 500 ppm on a mass basis, $$3.00 \leq (SP_{21} - SP_{11}) \leq 25.00 \quad (1), \text{ and}$$

$$21.00 \leq SP_{21} \quad (2).$$

2. The toner according to claim 1, wherein the content of the second monomer unit in the polymer A is 40.0 mol % to 95.0 mol %, based on the total number of moles of all the monomer units in the polymer A.

3. The toner according to claim 1, wherein the content of the polyvalent metal in the toner particle and the content of the second monomer unit in the polymer A satisfy a formula (3) below, $$(\text{Content of the polyvalent metal in the toner particle})/(\text{Content of the second monomer unit in the polymer } A) \geq 0.5 \text{ (ppm/mol \%)} \quad (3).$$

4. The toner according to claim 1, wherein the first polymerizable monomer is at least one selected from the group consisting of (meth)acrylic acid esters having a linear alkyl group having 18 to 36 carbon atoms.

5. The toner according to claim 1, wherein the second polymerizable monomer is at least one selected from the group consisting of compounds represented by following formulas (A) and (B):

(A)

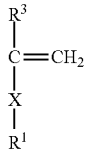

(B)

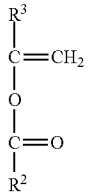

in the formula (A), X represents a single bond or an alkylene group having 1 to 6 carbon atoms, $R^1$ is a nitrile group (—C≡N), an amide group (—C(=O)NHR$^{10}$ ($R^{10}$ is a hydrogen atom or an alkyl group having 1 to 4 carbon atoms)), a hydroxy group, —COOR$^{11}$ ($R^{11}$ is an alkyl group having 1 to 6 carbon atoms or a hydroxyalkyl group having 1 to 6 carbon atoms), a urethane group (—NHCOOR$^{12}$ ($R^{12}$ is an alkyl group having 1 to 4 carbon atoms)), a urea group (—NH—C(=O)—N($R^{13}$)$_2$ ($R^{13}$ independently represent a hydrogen atom or an alkyl group having 1 to 6 carbon atoms)), —COO($CH_2$)$_2$NHCOOR$^{14}$ ($R^{14}$ is an alkyl group having 1 to 4 carbon atoms), or —COO($CH_2$)$_2$—NH—C(=O)—N($R^{15}$)$_2$ ($R^{15}$ independently represent a hydrogen atom or an alkyl group having 1 to 6 carbon atoms), and $R^3$ represents a hydrogen atom or a methyl group;

in the formula (B), $R^2$ represents an alkyl group having 1 to 4 carbon atoms, and $R^3$ represents a hydrogen atom or a methyl group.

6. The toner according to claim 1, wherein the amount of the polymer A in the binder resin is 50.0% by mass or more.

7. The toner according to claim 1, wherein the polymer A includes a monovalent metal, and the monovalent metal is at least one selected from the group consisting of Na, Li, and K.

8. The toner according to claim 7, wherein the amount of the monovalent metal is 50% by mass to 90% by mass based on the total of the amount of the polyvalent metal and the amount of the monovalent metal.

9. The toner according to claim 7, wherein a domain diameter of at least one of the polyvalent metal and the monovalent metal in a cross section of the toner particle is 10 nm to 50 nm.

10. The toner according to claim 1, wherein a complex elastic modulus at 65° C. is $1.0\times10^7$ Pa to $5.0\times10^7$ Pa, and a complex elastic modulus at 85° C. is $1.0\times10^5$ Pa or less.

11. The toner according to claim 1, wherein in a concentration distribution of the polyvalent metal in a cross section of the toner particle, the polyvalent metal concentration in a region from the surface of the toner particle to a depth of 0.4 μm is lower than the polyvalent metal concentration in a region deeper than 0.4 μm from the surface of the toner particle.

12. The toner according to claim 1, wherein the polymer A is a vinyl polymer.

13. The toner according to claim 1, wherein the second polymerizable monomer is at least one selected from the group consisting of compounds represented by following formulas (A) and (B):

(A)

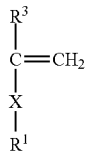

(B)

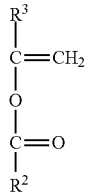

in the formula (A), X represents a single bond or an alkylene group having 1 to 6 carbon atoms, $R^1$ is a nitrile group (—C≡N), an amide group (—(=O)NHR$^{10}$ ($R^{10}$ is a hydrogen atom or an alkyl group having 1 to 4 carbon atoms)), a hydroxy group, —COOR$^{11}$ ($R^{11}$ is an alkyl group having 1 to 6 carbon atoms or a hydroxyalkyl group having 1 to 6 carbon atoms), a urea group (—NH—C(=O)—N($R^{13}$)$_2$ ($R^{13}$ independently represent a hydrogen atom or an alkyl group having 1 to 6 carbon atoms)), —COO($CH_2$)$_2$NHCOOR$^{14}$ ($R^{14}$ is an alkyl group having 1 to 4 carbon atoms), or —COO($CH_2$)$_2$—NH—C(=O)—N($R^{15}$)$_2$ ($R^{15}$ independently represent a hydrogen atom or an alkyl group having 1 to 6 carbon atoms), and $R^3$ represents a hydrogen atom or a methyl group;

in the formula (B), $R^2$ represents an alkyl group having 1 to 4 carbon atoms, and $R^3$ represents a hydrogen atom or a methyl group.

14. The toner according to claim 1, wherein the polymer A has a third monomer unit derived from a third polymerizable monomer different from the first polymerizable monomer and the second polymerizable monomer; and the third polymerizable monomer is at least one selected from the group consisting of styrene, methyl methacrylate and methyl acrylate.

15. A toner comprising a toner particle including a binder resin, wherein the binder resin includes a polymer A, the polymer A is a polymer of a composition including:

a first polymerizable monomer, and a second polymerizable monomer different from the first polymerizable monomer;

the first polymerizable monomer is at least one selected from the group consisting of (meth)acrylic acid esters having an alkyl group having 18 to 36 carbon atoms;

a content of the first polymerizable monomer in the composition is 5.0 mol % to 60.0 mol %, based on the total number of moles of all the polymerizable monomers in the composition;

a content of the second polymerizable monomer in the composition is 20.0 mol % to 95.0 mol %, based on the total number of moles of all the polymerizable monomers in the composition;

where an SP value of the first polymerizable monomer is denoted by $SP_{12}$ $(J/cm^3)^{0.5}$ and an SP value of the second polymerizable monomer is denoted by $SP_{22}$ $(J/cm^3)^{0.5}$, following formulas (4) and (5) are satisfied;

the polymer A includes a polyvalent metal;

the polyvalent metal is at least one selected from the group consisting of Mg, Ca, Al, and Zn; and a content of the polyvalent metal in the toner particle is 25 ppm to 500 ppm on a mass basis, $$0.60 \leq (SP_{22} - SP_{12}) \leq 15.00 \quad (4), \text{ and}$$

$$18.30 \leq SP_{22} \quad (5).$$

16. The toner according to claim 15, wherein the content of the second polymerizable monomer in the composition is 40.0 mol % to 95.0 mol %, based on the total number of moles of all the polymerizable monomers in the composition.

17. The toner according to claim 15, wherein the content of the polyvalent metal in the toner particle and the content of the second polymerizable monomer in the composition satisfy a formula (6) below, $$(\text{Content of the polyvalent metal in the toner particle})/(\text{Content of the second polymerizable monomer in the composition}) \geq 0.5 \text{ (ppm/mol \%)} \quad (6).$$

18. The toner according to claim 15, wherein the polymer A contains a first monomer unit derived from a first polymerizable monomer, and a second monomer unit derived from a second polymerizable monomer different from the first polymerizable monomer;

a content of the first monomer unit in the polymer A is 5.0 mol % to 60.0 mol %, based on the total number of moles of all the monomer units in the polymer A;

a content of the second monomer unit in the polymer A is 20.0 mol % to 95.0 mol %, based on the total number of moles of all the monomer units in the polymer A;

where an SP value of the first monomer unit is denoted by $SP_{11}$ $(J/cm^3)^{0.5}$ and an SP value of the second monomer unit is denoted by $SP_{21}$ $(J/cm^3)^{0.5}$, following formulas (1) and (2) are satisfied, and the content of the polyvalent metal in the toner particle and the content of the second polymerizable monomer in the composition satisfy a formula (6) below;

$$3.00 \leq (SP_{21} - SP_{11}) \leq 25.00 \quad (1)$$

$$21.00 \leq SP_{21} \quad (2) \text{ and}$$

$$(\text{Content of the polyvalent metal in the toner particle})/(\text{Content of the second polymerizable monomer in the composition}) \geq 0.5 \text{ (ppm/mol \%)} \quad (6).$$

19. A method for producing a toner, comprising:

a step of preparing a resin fine particle-dispersed solution including a binder resin;

a step of adding a flocculant to the resin fine particle-dispersed solution to form aggregated particles; and a step of heating and fusing the aggregated particles to obtain a dispersion solution including toner particles, wherein the binder resin includes a polymer A, the polymer A is a polymer of a composition including:

a first polymerizable monomer, and a second polymerizable monomer different from the first polymerizable monomer;

the first polymerizable monomer is at least one selected from the group consisting of (meth)acrylic acid esters having an alkyl group having 18 to 36 carbon atoms;

a content of the first polymerizable monomer in the composition is 5.0 mol % to 60.0 mol %, based on the total number of moles of all the polymerizable monomers in the composition;

a content of the second polymerizable monomer in the composition is 20.0 mol % to 95.0 mol %, based on the total number of moles of all the polymerizable monomers in the composition;

where an SP value of the first polymerizable monomer is denoted by $SP_{12}$ $(J/cm^3)^{0.5}$ and an SP value of the second polymerizable monomer is denoted by $SP_{22}$ $(J/cm^3)^{0.5}$, following formulas (4) and (5) are satisfied;

the flocculant includes a polyvalent metal;

the polyvalent metal is at least one selected from the group consisting of Mg, Ca, Al, and Zn; and a content of the polyvalent metal in the toner particle is 25 ppm to 500 ppm on a mass basis, $$0.60 \leq (SP_{22} - SP_{12}) \leq 15.00 \quad (4), \text{ and}$$

$$18.30 \leq SP_{22} \quad (5).$$

20. The method according to claim 19, further comprising a step of adding a chelating compound having a chelating ability with respect to a metal ion to the dispersion solution including the toner particles.

* * * * *